US009004482B2

(12) United States Patent
Ishikawa et al.

(10) Patent No.: US 9,004,482 B2
(45) Date of Patent: Apr. 14, 2015

(54) SHEET CONVEYOR AND IMAGE FORMING APPARATUS INCORPORATING SAME

(71) Applicants: Yoshikuni Ishikawa, Tokyo (JP); Manabu Nonaka, Kanagawa (JP)

(72) Inventors: Yoshikuni Ishikawa, Tokyo (JP); Manabu Nonaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/914,959

(22) Filed: Jun. 11, 2013

(65) Prior Publication Data

US 2014/0001699 A1 Jan. 2, 2014

(30) Foreign Application Priority Data

Jun. 28, 2012 (JP) ..... 2012-146124

(51) Int. Cl.
*B65H 3/16* (2006.01)
*B65H 3/18* (2006.01)

(52) U.S. Cl.
CPC ..... *B65H 3/18* (2013.01); *B65H 2403/41* (2013.01); *B65H 2404/25* (2013.01); *B65H 2404/255* (2013.01); *B65H 2404/2693* (2013.01)

(58) Field of Classification Search
CPC ..... B65H 3/04; B65H 3/047; B65H 3/18; B65H 3/54
USPC ..... 271/4.05, 10.06, 18.1, 34
See application file for complete search history.

(56) References Cited

U.S. PATENT DOCUMENTS

| | | | | |
|---|---|---|---|---|
| 8,177,217 | B2 * | 5/2012 | Takahashi et al. | 271/18.1 |
| 8,474,811 | B2 * | 7/2013 | Takahashi et al. | 271/18.1 |
| 2011/0062651 | A1 | 3/2011 | Higaki et al. | |
| 2011/0127711 | A1 * | 6/2011 | Takahashi et al. | 271/18.1 |
| 2012/0193861 | A1 * | 8/2012 | Takahashi et al. | 271/10.06 |

FOREIGN PATENT DOCUMENTS

| | | |
|---|---|---|
| JP | 2003-237958 | 8/2003 |
| JP | 2010-126317 | 6/2010 |
| JP | 2011-111293 | 6/2011 |
| JP | 2012-121672 | 6/2012 |

OTHER PUBLICATIONS

Machine translation of Japanese Publication JP 2003-237958 (Shirai).*

* cited by examiner

*Primary Examiner* — David H Bollinger
(74) *Attorney, Agent, or Firm* — Harness, Dickey & Pierce, P.L.C.

(57) ABSTRACT

A sheet conveyor incorporated in an image forming apparatus includes an attraction/separation unit including an attraction belt, a first tension roller, and a second tension roller, a support member to support the attraction/separation unit, a roller drive unit to rotate one of the first and second tension rollers, a charging member to uniformly charge a surface of the attraction belt, a mechanism to swing the attraction/separation unit to move the attraction belt reciprocally about the support member between a sheet attraction position and a sheet conveyance position being located farther from the sheet stack than the sheet attraction position, and a pressing member disposed inside a loop of the attraction belt to press the attraction belt at the sheet attraction position toward the sheet stack and separating from the attraction belt at the sheet conveyance position.

13 Claims, 14 Drawing Sheets

SHEET CONVEYOR AND IMAGE FORMING APPARATUS INCORPORATING SAME

CROSS-REFERENCE TO RELATED APPLICATIONS

This patent application is based on and claims priority pursuant to 35 U.S.C. §119 to Japanese Patent Application No. 2012-146124, filed on Jun. 28, 2012 in the Japan Patent Office, the entire disclosure of which is hereby incorporated by reference herein.

BACKGROUND

1. Technical Field

Embodiments of the present invention relate to a sheet conveyor for feeding and conveying a sheet for image forming, and an image forming apparatus such as a printer, facsimile machine, copier, and so forth including the sheet conveyor.

2. Related Art

As one type of a sheet conveyor that loads a stack of sheets of originals or recording media sheets and feeds the stack of sheets one by one toward a subsequent stage, an electrostatic sheet feeder that attracts and separates a sheet electrostatically has been proposed.

One example of such a sheet conveyor includes an attraction/separation unit including a dielectric attraction belt stretched around two rollers, a charger to charge the attraction belt with an AC charge, and a holder to hold the attraction belt and the charger and which rotatably supports the two rollers. The holder is fixed to a rotation shaft provided upstream from the two rollers in a sheet conveyance direction. Further, a mechanism is provided to swing the attraction/separation unit about the rotation shaft so that the attraction belt moves reciprocally between a sheet attraction position and a sheet conveyance position. The sheet attraction position is where the attraction belt contacts an uppermost sheet of a sheet stack that is placed on a bottom plate of a sheet tray to attract the uppermost sheet. The sheet conveyance position is where the attraction belt separates from the sheet stack and conveys the uppermost sheet attracted thereto to a later stage.

Before conveyance of the sheet, the attraction belt held by the holder via the two rollers remains separated from the sheet stack. When separating the uppermost sheet from the sheet stack for transfer, one of the two rollers functions as a driving roller that is rotated by a drive source and that rotates the attraction belt for applying an alternating charge to the attraction belt. After being charged, the attraction belt stops and the mechanism moves the attraction/separation unit toward the sheet stack to the sheet attraction position. In consequence, the attraction belt contacts the uppermost sheet of the sheet stack for attraction.

When the uppermost sheet of the sheet stack contacts the attraction belt, the mechanism moves the attraction/separation unit in a direction to separate from the sheet stack. Consequently, the attraction belt lifts the uppermost sheet attracted thereto, resulting in separation of the uppermost sheet from the rest of the sheet stack. Upon the attraction belt reaching the sheet conveyance position, the driving roller rotates the attraction belt to convey the uppermost sheet onward to a later stage.

The electrostatic attraction force generated between the attraction belt and the uppermost sheet increases as the attraction belt approaches the uppermost sheet. For best results, it is preferable that the attraction belt be pressed against the uppermost sheet with a constant force sufficient to uniformly contact the attraction belt against the uppermost sheet. Accordingly, the sheet conveyor includes a planar pressing member disposed inside the loop formed by the attraction belt and a spring to bias the pressing member to contact against the inner surface of the attraction belt.

However, friction generated between the attraction belt and the pressing member imposes a load on the attraction belt that may cause the attraction belt to slip on the driving roller and result in a sheet conveyance failure.

SUMMARY

The present invention provides a novel sheet conveyor including an attraction/separation unit, a support member, a roller drive unit, a charging member, a mechanism, and a pressing member. The attraction/separation unit includes an endless attraction belt disposed facing a top surface of a sheet stack, a first tension roller, and a second tension roller located upstream from the first tension roller in a sheet conveyance direction to stretch the attraction belt taut together with the first tension roller. The attraction belt is wound about the rollers in a loop, rotatably supported by the first tension roller and the second tension roller. The support member supports the attraction/separation unit. The roller drive unit operatively connected to one of the first tension roller and the second tension roller. The charging member uniformly charges a surface of the attraction belt. The mechanism swings the attraction/separation unit to move the attraction belt reciprocally about the support member between a sheet attraction position at which the uppermost sheet of the sheet stack contacts and attracts the attraction belt and a sheet conveyance position at which the uppermost sheet attracted to the attraction belt is conveyed. The sheet conveyance position is located farther from the sheet stack than the sheet attraction position. The pressing member is disposed inside the loop into which the attraction belt is formed to press the attraction belt against the sheet stack at the sheet attraction position. The pressing member separates from the attraction belt at the sheet conveyance position.

Further, the present invention provides a novel image forming apparatus including the above-described sheet conveyor and an image forming device to form an image on a surface of a sheet conveyed from the sheet conveyor.

BRIEF DESCRIPTION OF THE DRAWINGS

A more complete appreciation of the invention and many of the advantages thereof will be obtained as the same becomes better understood by reference to the following detailed description when considered in connection with the accompanying drawings, wherein.

DETAILED DESCRIPTION

Figure 1:
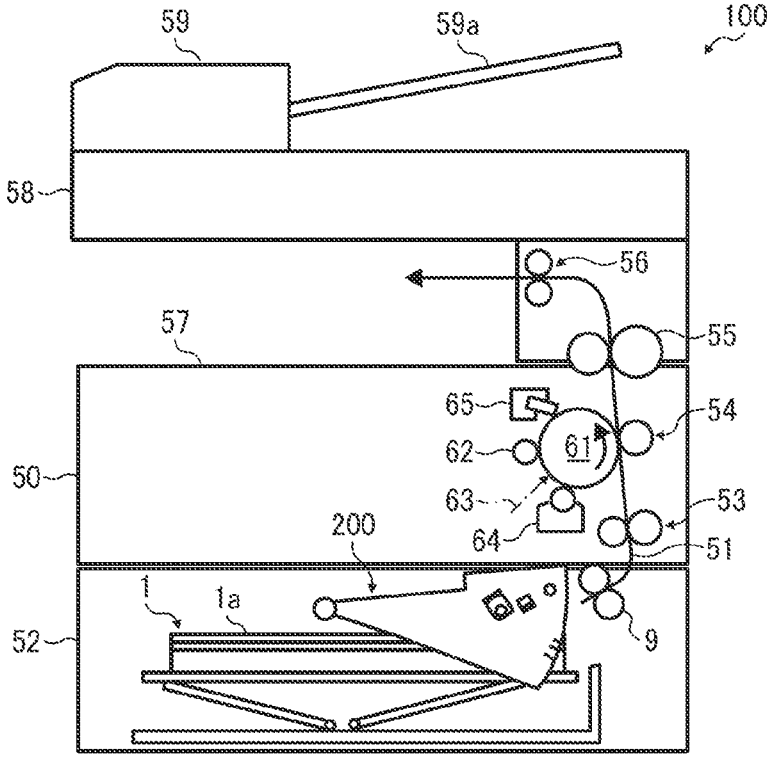
FIG. 1 is a diagram illustrating a configuration of an image forming apparatus according to an embodiment of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present invention.

The terminology used herein is for describing particular embodiments and is not intended to be limiting of exemplary embodiments of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of the present invention. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of the present invention.

The present invention is applicable to any image forming apparatus, and is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of the present invention are described.

A description is given of a configuration of an electrophotographic image forming apparatus according to an embodiment of the present invention.

FIG. 1 is a diagram illustrating a configuration of an image forming apparatus 100 according to an embodiment of the present invention.

As illustrated in FIG. 1, the image forming apparatus 100 may be a copier, a facsimile machine, a printer, a multifunction printer having at least one of copying, printing, scanning, plotter, and facsimile functions, or the like. The image forming apparatus 100 may form an image by an electrophotographic method, an inkjet method, and/or the like. According to this embodiment, the image forming apparatus 100 functions as a copier for forming an image on a recording medium by the electrophotographic method.

The image forming apparatus 100 illustrated in FIG. 1 includes an automatic document feeder (ADF) 59, a document reader 58, an image forming device 50, and a sheet feeder 52.

The ADF 59 includes a document setting tray 59*a* on which a stack of original documents is placed. The ADF 59 automatically takes several documents placed on the document setting tray 59*a* and feeds the document one page at a time onto a contact glass or a platen provided on the document reader 58.

The document reader 58 reads the document conveyed onto the contact glass by the ADF 59.

The image forming device 50 forms an image based on image data of the original image scanned by the document reader 58 and transfer the image data onto a sheet functioning as a recording medium supplied from the sheet feeder 52.

The sheet feeder 52 accommodates a sheet stack 1 having multiple sheets including an uppermost sheet 1*a* on top thereof and feeds the uppermost sheet 1*a* to the image forming device 50.

The image forming device 50 includes a photoconductor 61 functioning as an electrostatic image carrier and image forming units and components disposed around the photoconductor 61. The image forming units and components are, for example, a charging device 62, a development device 64, a transfer device 54, and a photoconductor cleaning device 65. The image forming device 50 further includes a non-illustrated optical writing device and a fixing device 55. The optical writing device emits a laser light beam 63 to the photoconductor 61. The fixing device 55 fixes a toner image formed on the surface of a sheet.

In this image forming device 50, as the photoconductor 61 starts rotating, the charging device 62 uniformly charges the surface of the photoconductor 61. Then, the laser light beam 63 generated based on image data input from a personal computer (PC), a word processor and so forth and image data of the original documents read by the document reader 58 is emitted to the photoconductor 61 to form an electrostatic latent image. Thereafter, the development device 64 develops the electrostatic latent image with toner into a toner image on the surface of the photoconductor 61.

By contrast, the sheet feeder 52 separates and conveys the multiple sheets one by one from the sheet stack 1*a*, and the separated sheet conveyed by a pair of conveyance rollers 9 in a sheet path 51 abuts against a pair of registration rollers 53 to stop. In synchronization with toner image formation of the image forming device 50, the sheet contacting the pair of registration rollers 53 is conveyed to a transfer portion where the photoconductor 61 and the transfer device 54 are disposed facing each other. At the transfer portion, the toner image formed on the photoconductor 61 is transferred onto the sheet fed by the sheet feeder 52. The toner image formed on the sheet is fixed to the sheet in the fixing device 55, and is discharged by a pair of sheet discharging rollers 56 to a sheet discharging tray 57. The photoconductor cleaning device 65 removes residual toner remaining on the surface of the photoconductor 61 after transfer of the toner image to clean the surface of the photoconductor 61 for the subsequent image forming operation.

Figure 2:
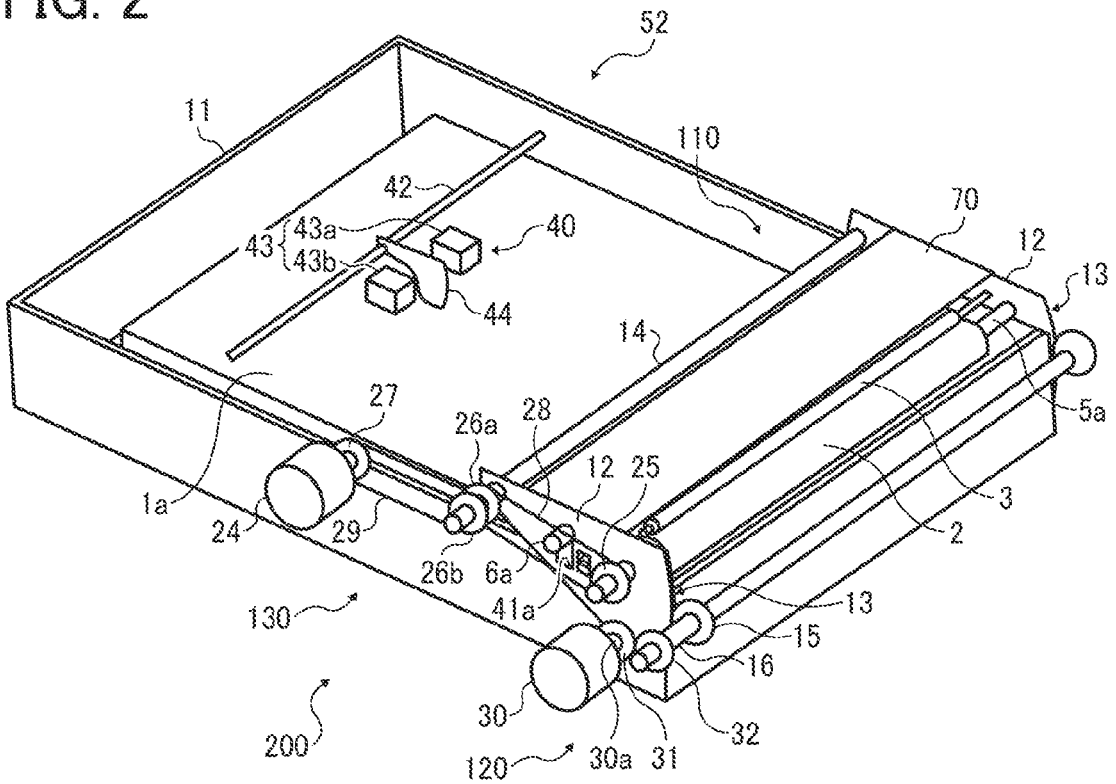
FIG. 2 is a perspective view illustrating a schematic configuration of a sheet feeder.
Figure 3:
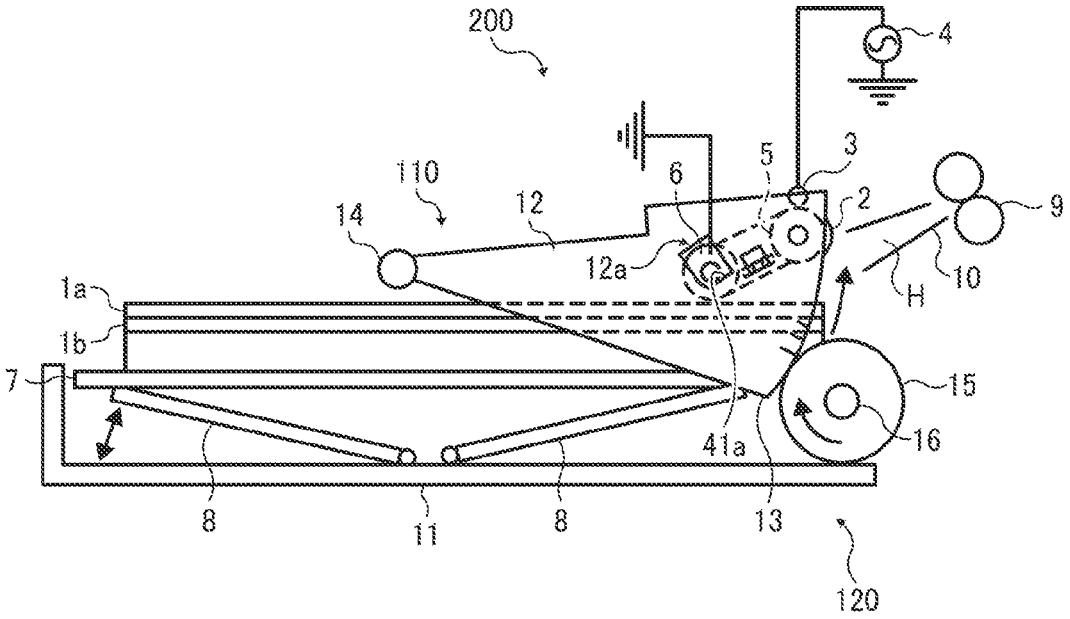
FIG. 3 is a diagram illustrating the sheet feeder.
Figure 4A:
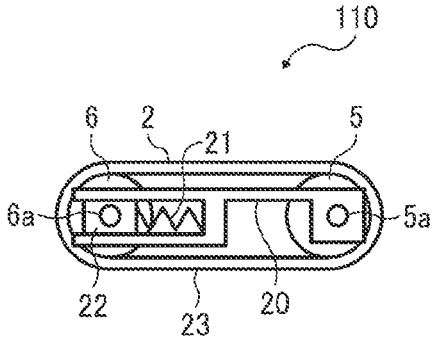
FIG. 4A is a side view illustrating a main part of the attraction/separation unit.
Figure 4B:
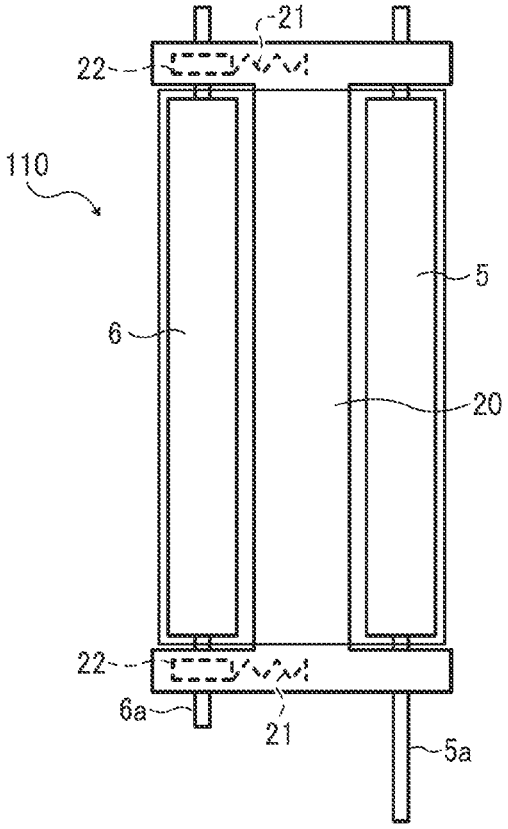
FIG. 4B is a top view illustrating the main part of the attraction/separation unit

FIG. 2 is a perspective view illustrating a schematic configuration of the sheet feeder 52, FIG. 3 is a diagram illustrating the sheet feeder 52, FIG. 4A is a side view illustrating a main part of the attraction/separation unit 110, and FIG. 4B is a top view illustrating the main part of the attraction/separation unit 110.

The sheet feeder 52 includes a sheet tray 11 and a sheet conveyor 200. The sheet tray 11 functions as a sheet container on which a stack of sheets is loaded. The sheet conveyor 200 separates and conveys the uppermost sheet 1*a* placed on top of the sheet stack 1 including multiple sheets on the sheet tray 11.

As illustrated in FIG. 3, the sheet tray 11 includes a bottom plate 7 on which the sheet stack 1 having multiple sheets is placed. To support the bottom plate 7, a supporting member 8 is rotatably attached between a bottom part of the sheet tray 11 and the bottom plate 7.

Further, as illustrated in FIG. 2, the sheet feeder 52 includes a sheet detector 40 that detects that the uppermost sheet 1*a* of the sheet stack 1 has reached a predetermined position.

The sheet detector 40 includes a feeler 44 and a transmission optical sensor 43. The feeler 44 is rotatably supported by a shaft 42 provided in the image forming apparatus 100.

As the supporting member 8 is rotated by a non-illustrated drive motor to lift the bottom plate 7, the sheet stack 1 placed on the bottom plate 7 also elevates to cause the uppermost sheet 1*a* to contact the feeler 44. At this time, a light receiving portion 43*a* of the transmission optical sensor 43 receives light from a light emitting portion 43*b*. As the bottom plate 7 is further lifted, the feeler 44 blocks the light emitted by the light emitting portion 43*b* and the light receiving portion 43*a* stops receiving the light. Thus, the transmission optical sensor 43 detects that the uppermost sheet 1*a* of the sheet stack 1 has reached a predetermined position, resulting to stop rotation of the supporting member 8.

The sheet conveyor 200 includes an attraction/separation unit 110, a mechanism 120 to swing the attraction/separation unit 110, and a driving mechanism 130 to move the attraction belt 2 endlessly. The attraction/separation unit 110 includes an attraction belt 2 that is stretched taut by the downstream tension roller 5 and the upstream tension roller 6, as illustrated in FIGS. 4A and 4B.

The attraction belt 2 have a double layer construction that includes a front layer including a polyethylene terephthalate film having a resistivity of about $10^8$ Ω·cm (ohm centimeters) or greater with a thickness of about 50 μm and a conductive layer formed by aluminum evaporation having a resistivity of about $10^6$ Ω·cm or smaller. The attraction belt 2 with a double layer construction enables the conductive layer to function as a grounded opposite polarity. A charging member 3 that serves as a charging unit to apply electrical charge to the attraction belt 2 can be disposed at any position on the front layer of the attraction belt 2. Further, an anti-offset rib 23 is provided on an inner side of both ends of the attraction belt 2 in the lateral direction so that the end surfaces on both sides of the downstream tension roller 5 and the upstream tension roller 6 engage with the rib 23 to prevent the downstream tension roller 5 and the upstream tension roller 6 to offset toward the attraction belt 2.

The downstream tension roller 5 has a surface formed by a conductive rubber layer having a resistivity of about $10^6$ Ω·cm and the upstream tension roller 6 is a metallic roller. Both the downstream tension roller 5 and the upstream tension roller 6 are grounded. The downstream tension roller 5 has a small curvature suitable for separating sheets from the attraction belt 2. Specifically, the smaller diameter of the downstream tension roller 5 produces the greater curvature, and therefore the sheet attracted and conveyed by the attraction belt 2 can enter a conveyance path H formed by a guide member 10 disposed downstream from the downstream tension roller 5 in the sheet conveyance direction.

Further, as illustrated in FIGS. 4A and 4B, a housing 20 includes a housing body 20*a* and the shaft 5*a* of the downstream tension roller 5 is rotatably supported to the housing 20. The upstream tension roller 6 rotatably supported by bearings 22 held slidably to the housing body 20*a* in the sheet conveyance direction. Each bearing 22 is biased by respective spring 21 toward the upstream side of the sheet conveyance direction. With this configuration, the upstream tension roller 6 is biased toward the upstream side of the sheet conveyance direction to apply a tension force to the attraction belt 2.

Figure 5:
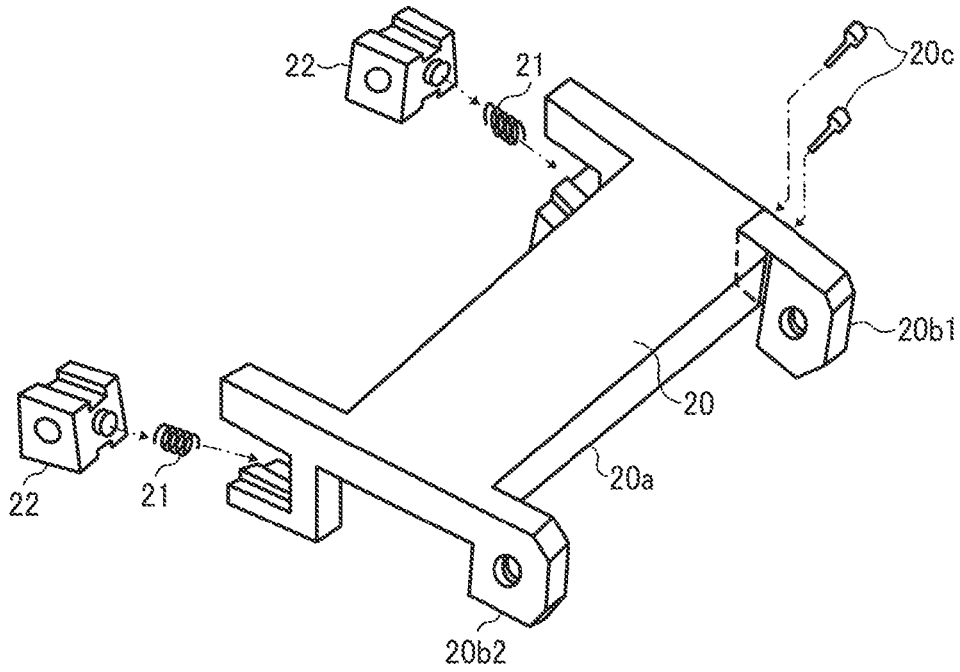
FIG. 5 is an exploded view of a housing of the attraction/separation unit.

FIG. 5 is an exploded view of the housing 20. The housing 20 includes two hole-bearing flanges 20*b*1 and 20*b*2 to rotatably support the shaft 5*a* of the downstream tension roller 5. The hole-bearing flange 20*b*1 is detachable and may be fixed to the housing body 20*a* of the housing 20 with a pair of fixing screws 20*c*. When assembling the housing 20 to the shaft 5*a* of the downstream tension roller 5, the detachable hole-bearing flange 20*b*1 is removed from the housing body 20*a* and the hole-bearing flange 20*b*2 is used to rotatably support the shaft 5*a* of the downstream tension roller 5. Then, while receiving the shaft 5*a* of the downstream tension roller 5, the detachable hole-bearing flange 20*b*1 is fixed to the housing body 20*a* using the pair of fixing screws 20*c*.

As illustrated in FIGS. 2 and 3, the attraction/separation unit 110 includes brackets 12 at both ends of the attraction belt 2 in the lateral direction to swingably hold the attraction belt 2. The brackets 12 are rotatably supported by a bracket supporting shaft 14 that serves as a supporting member and that is disposed upstream from the upstream tension roller 6 in the sheet conveyance direction. With this configuration, the mechanism 120, details of which will be described later, can swing the attraction/separation unit 110 about the bracket supporting shaft 14 between the sheet attraction position and a sheet conveyance position. It is to be noted that the sheet attraction position is where the attraction belt 2 contacts an uppermost sheet 1*a* of the sheet stack 1 and the sheet conveyance position is where the attraction belt 2 separates the uppermost sheet 1*a* attracted thereto from the sheet stack and conveys the uppermost sheet 1*a* to a later stage.

Each of the brackets 12 includes a slot 12*a* thorough which a shaft 6*a* of the upstream tension roller 6 runs. Through the slot 12*a*, the upstream tension roller 6 is movably supported to the brackets 12.

By contrast, the shaft 5*a* of the downstream tension roller 5 that runs through a non-illustrated opening formed on each bracket 12 so that the downstream tension roller 5 is held in a fixed manner to the brackets 12.

As illustrated in FIG. 3, when the attraction/separation unit 110 is located at the sheet conveyance position, the shaft 6*a* of the upstream tension roller 6 remains abut against the lower end surface 41*a* of the slot 12*a*.

The slot 12*a* formed on each bracket 12 is curved along a center of rotation of the downstream tension roller 5 such that a length from the center of rotation of the upstream tension roller 6 to the center of rotation of the downstream tension roller 5 does not change even when the shaft 6*a* of the upstream tension roller 6 moves in the slot 12*a*. With this configuration, the tension force of the attraction belt 2 can be maintained upon movement of the upstream tension roller 6 in the slot 12*a*.

In general, even if the tension force of the attraction belt 2 is 5N or smaller, the downstream tension roller 5 and the upstream tension roller 6 do not slip on the attraction belt 2. Accordingly, the attraction belt 2 is rotated to convey the uppermost sheet 1*a* attracted to the attraction belt 2.

By contrast, if the sheet has a special feature such as a high adhesion, the downstream tension roller 5 and the upstream tension roller 6 may slip on the attraction belt 2. Therefore, the coefficient of friction of the surfaces of the downstream tension roller 5 and the upstream tension roller 6 to the attraction belt 2 is preferably increased to prevent the tension rollers 5 and 6 from slippage on the attraction belt 2.

Figure 6:
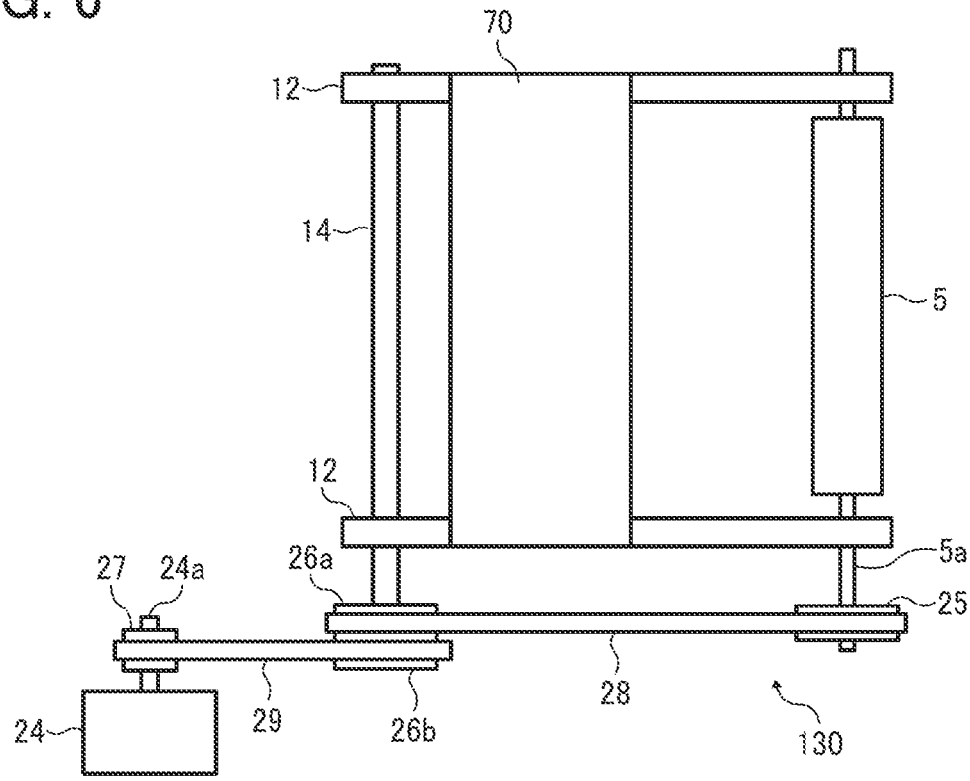
FIG. 6 is a top view illustrating a schematic configuration of a driving mechanism for rotating an attraction belt.

FIG. 6 illustrates a schematic configuration of the driving mechanism 130 that rotates the attraction belt 2.

A first driven pulley 26*a* and a second driving pulley 26*b* are fixed to one end of the bracket supporting shaft 14 that rotatably supports the bracket 12. A second driven pulley 25 is fixed to one end of the downstream tension roller 5. A driven timing belt 28 is wound around the first driven pulley 26*a* and the second driven pulley 25. Further, a drive motor 24 that functions as a roller drive unit is provided upstream from the bracket supporting shaft 14 in the sheet conveyance direction. A first driving pulley 27 is fixed to a motor shaft 24*a* of the drive motor 24. A driving timing belt 29 is wound around the first driving pulley 27 and the second driving pulley 26*b*.

As the drive motor 24 drives, the downstream tension roller 5 rotates via the driving timing belt 29 and the driven timing belt 28. This rotation of the downstream tension roller 5 rotates the attraction belt 2, and the upstream tension roller 6 is rotated due to a friction force exerted on an inner circumferential surface of the attraction belt 2.

Further, in this embodiment, a driving force that is exerted by the drive motor 24 is transmitted to the downstream tension roller 5 via the bracket supporting shaft 14 that supports the brackets 12. As described below, the attraction/separation unit 110 swings about the bracket supporting shaft 14. With this configuration, when the attraction/separation unit 110 swings, the length between the downstream tension roller 5 and the bracket supporting shaft 14 does not change. Therefore, the tension of the driven timing belt 28 is maintained to favorably transmit the driving force to the downstream tension roller 5.

The driving mechanism 130 may be configured to transmit a driving force from the drive motor 24 to the upstream tension roller 6. In this case, the upstream tension roller 6 serves as a driven roller to rotate the attraction belt 2.

Further, as illustrated in FIGS. 2 and 3, the sheet conveyor 200 further includes the mechanism 120 located on a downstream side of the sheet feeder 52 in the sheet conveyance direction. The mechanism 120 for swinging the bracket 12 includes rack gears 13, a pinion gear 15, and a swing motor 30. Each of the rack gears 13 functions as a first drive transmission member formed at the end portion of the respective brackets 12 on a downstream side of the sheet conveyance direction. The pinion gear 15 functions as a second drive transmission member fixed to the rotary shaft 16 and meshing with the rack gears 13. The swing motor 30 includes a motor shaft 30*a* to which a motor gear 31 is fixed. The rotary shaft 16 has a driven gear 32 at one end to mesh with the motor gear 31.

The pinion gears 15 provided to the respective brackets 12 are fixed to the rotary shaft 16 that rotates about the same axis as the pinion gears 15. With this configuration, as the swing motor 30 rotates the rotary shaft 16, the pinion gears 15 are rotated. Accordingly, a single swing motor (i.e., the swing motor 30) can rotate two pinion gears (i.e., the pinion gears 15) provided at both lateral ends of the belt, thereby reducing the number of parts and components and manufacturing the units and devices at lower costs. Further, with a simple configuration, rack and pinion gears provided at both lateral ends of the belt can be synchronized.

The rack gear 13 having a round shape is integrally formed on the bracket 12. Upon rotation of the attraction/separation unit 110, the rack gear 13 swings about the bracket supporting shaft 14. This configuration of the rack gear 13 can maintain meshing of the rack gear 13 with the pinion gear 15 when the attraction/separation unit 110 swings. By comparing with a state in which a rack gear that is formed separate from the bracket 12 is attached to the bracket 12, the rack gear 13 integrally formed on the bracket 12 at a downstream end in the sheet conveyance direction can reduce the number of parts and components, contributing to a simpler configuration. Further, by comparing with the mechanism including the pinion gear mounted on the attraction/separation unit 110, the mechanism 120 including the pinion gear 15 mounted on the image forming apparatus 100 can transmit the driving force to the pinion gear more simply.

With this configuration of the mechanism 120, the swing motor 30 is driven to rotate the pinion gear 15, moving the rack gear 13 to separate from the sheet stack 1. Consequently, each bracket 12 rotates about the bracket supporting shaft 14.

Further, the brackets 12 are connected via a reinforcement member 70, so that the brackets 12 can swing integrally. This configuration prevents the attraction belt 2 supported by the brackets 12 from twisting due to movement of the brackets 12 and the uppermost sheet 1*a* from separating from the attraction belt 2.

Figure 7:
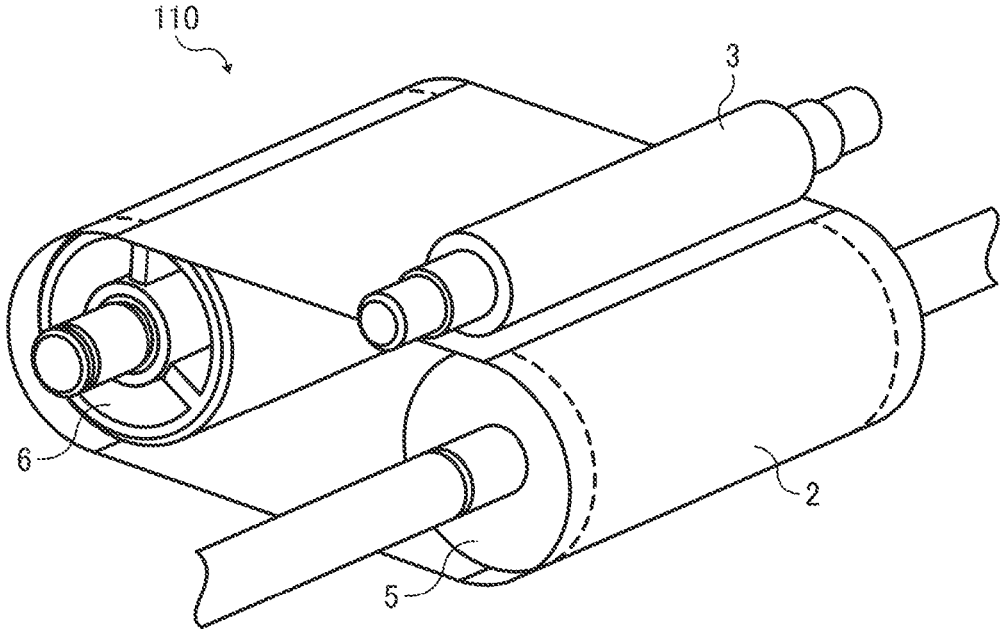
FIG. 7 is a perspective view illustrating a main part of the attraction/separation unit.

As illustrated in FIG. 7, the charging member 3 functioning as a charger, as illustrated in FIG. 3, contacts the surface of the attraction belt 2 to charge the surface of the attraction belt 2. The charging member 3 according to the present embodiment is a roller rotatably disposed to the attraction/separation unit 110. The position of the charging member 3 with respect to the attraction belt 2 is uniquely determined. The charging member 3 is operatively connected to the charging power source 4 that generates alternating current.

Figure 8:
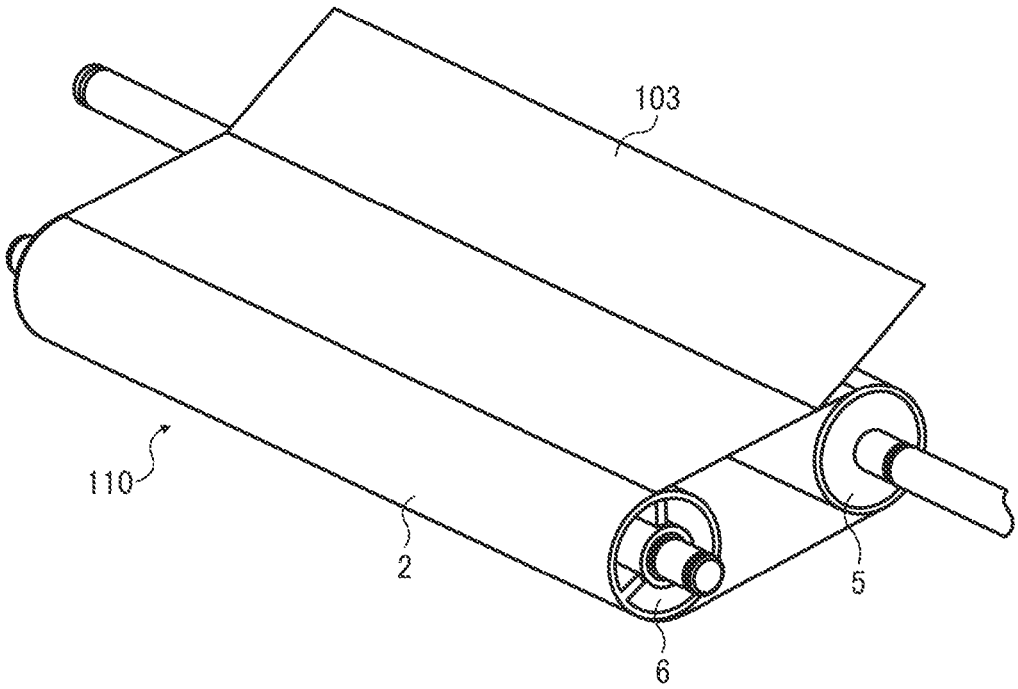
FIG. 8 is a perspective view illustrating a main part of a modification of the attraction/separation unit.

It is to be noted that the shape of the charging member 3 is not limited to a roller. For example, a blade-type electrode 103 as illustrated in FIG. 8 can be applied as well. By comparing with the roller-type charging member, the blade-type charging member (i.e., the blade-type electrode 103) can form electric potential patterns at smaller pitches or intervals, increase the attraction force to the uppermost sheet 1*a* of the sheet stack 1 more quickly, and reduce the attraction force to the second and subsequent sheets more quickly. Therefore, the blade-type charging member can enhance a reduction in the period of time for separation. Further, smaller pitches of alternating charge can be achieved, and therefore the blade-type charging member can charge the attraction belt 2 stably even if the attraction belt 2 includes small waviness.

Next, a description is given of sheet feeding operation using the sheet conveyor 200 according to the present embodiment, with reference to FIGS. 9A through 9E.

Figure 9A:
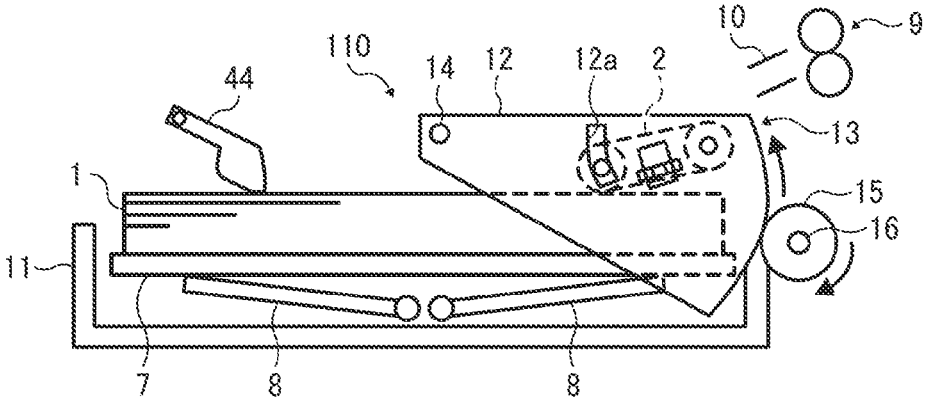
FIGS. 9A through 9E are diagrams illustrating sheet conveyance operations of a sheet conveyor.

As illustrated in FIG. 9A, the bottom plate 7 generally stays at a low position in the sheet tray 11 and the attraction/separation unit 110 is at the sheet attraction position. Upon receiving a sheet feed signal, the swing motor 30 (refer to FIG. 2) is driven to rotate the pinion gear 15 clockwise in FIG. 9A. With this action, the attraction/separation unit 110 swings about the bracket supporting shaft 14 counterclockwise in the figure. Upon the attraction/separation unit 110 reaching the sheet conveyance position, the swing motor 30 stops driving.

As shown in FIG. 5A, the applied alternating charge is discharged to form a charge pattern in which pitches preferably in a range from about 5 mm to about 15 mm are alternately provided on the front layer 42*a* of the endless belt 42 according to a frequency of the charging power source 50 for generating the alternating current and a rotation speed (e.g., a circumferential speed) of the endless belt 42.

Figure 9B:
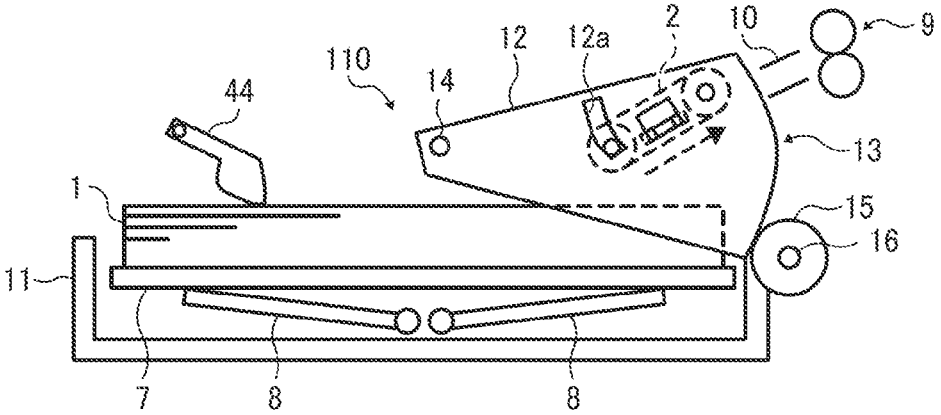

As illustrated in FIG. 9B, upon the attraction/separation unit 110 stopping at the sheet conveyance position, the drive motor 24 (see FIG. 2) is driven to rotate the attraction belt 2 endlessly. Then, the charging power source 4 applies an alternating charge alternately to the rotating attraction belt 2 via the charging member 3. As a result, the applied alternating charge is discharged to form a charge pattern in which pitches preferably in a range from about 5 mm to about 15 mm are alternately provided on the surface of the attraction belt 2 according to a frequency of the charging power source 4 for generating the alternating current and a rotation speed (e.g., a circumferential speed) of the attraction belt 2. As well as the alternating-current voltage, the charging power source 4 may also provide a direct-current voltage alternated between high and low potentials. For example, the waveform of the voltage may be a rectangular or sine wave. According to this embodiment, the charging power source 4 applies a rectangular wave having amplitude of about 4 kV to the surface of the attraction belt 2.

Figure 9C:
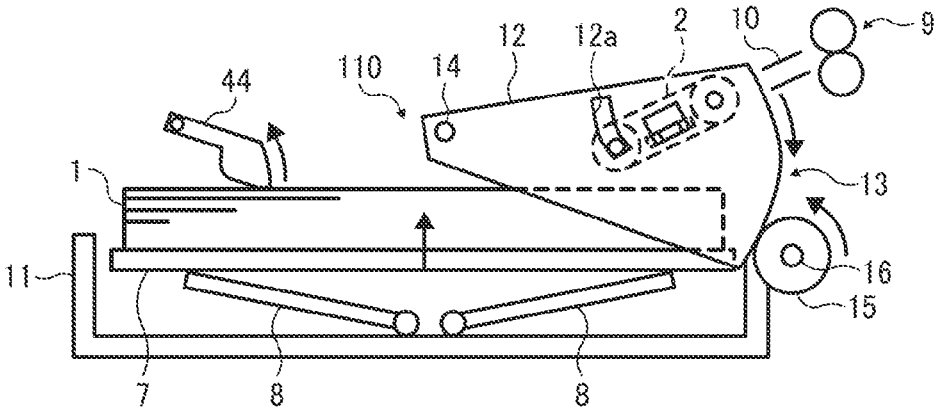

After completion of charging to the attraction belt 2, the attraction belt 2 is stopped and the bottom plate 7 that has been located at the lower position of the sheet tray 11 starts to elevate, as illustrated in FIG. 9C. About the same time, the swing motor 30 is driven backward to rotate the pinion gear 15 counterclockwise in FIG. 9C. Accordingly, the attraction/separation unit 110 swings about the bracket supporting shaft 14 clockwise in FIG. 9C or toward the sheet stack 1.

As the bottom plate 7 ascends and the attraction/separation unit 110 descends, the uppermost sheet 1*a* of the sheet stack 1 contacts the upstream tension roller 6 via the attraction belt 2. Then, as the bottom plate 7 further ascends and the attraction/separation unit 110 further descends, the upstream tension roller 6 is lifted by elevation of the sheet stack 1. With this action, the upstream tension roller 6 that has abut against the lower end surface 41*a* of the slot 12*a* moves upward along the slot 12*a*. Along with elevation of the bottom plate 7, the feeler 44 rotates counterclockwise in FIG. 9C. When the uppermost sheet 1*a* of the sheet stack 1 reaches the predetermined position, the feeler 44 blocks the light emitted by the light emitting portion 43*b* of the transmission optical sensor 43. This indicates that the transmission optical sensor 43 has detected arrival of the uppermost sheet 1*a* of the sheet stack 1 at the predetermined position, and the bottom plate 7 stops elevation.

Further, upon the attraction/separation unit 110 reaching the sheet attraction position, the swing motor 30 stops its rotation. In a case in which the swing motor 30 is a stepping motor, by controlling the swing motor 30 based on the angle of rotation (the number of pulses), the attraction/separation unit 110 can be stopped at the sheet attraction position accurately. By contrast, in a case in which the swing motor 30 is a DC motor, the control based on the driving period of time can stop the attraction/separation unit 110 at the sheet attraction position accurately.

Figure 9D:
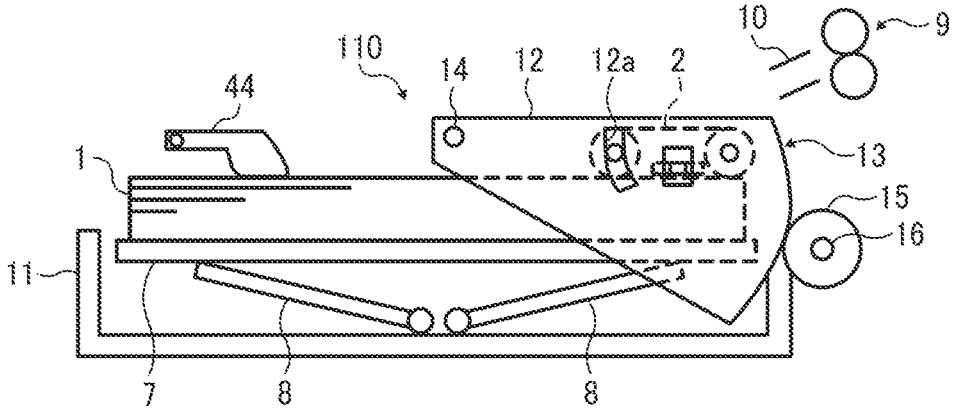

As illustrated in FIG. 9D, when the elevation of the bottom plate 7 stops and then the descendant (swing) of the attraction/separation unit 110 stops, a region where the attraction belt 2 faces the sheet stack 1 contacts the uppermost sheet 1*a* of the sheet stack 1. As the attraction belt 2 contacts the uppermost sheet 1*a*, Maxwell stress acts on the uppermost sheet 1*a*, which is a dielectric material, due to the non-uniform electric field generated by the charge patterns formed on the outer circumferential surface of the attraction belt 2. As a result, the uppermost sheet 1*a* of the sheet stack 1 is attracted to the attraction belt 2.

After the attraction/separation unit 110 stands by for a predetermined time in the state illustrated in FIG. 9D and the uppermost sheet 1*a* is attracted to the attraction belt 2, the swing motor 30 is driven to rotate the pinion gear 15 clockwise so that the attraction/separation unit 110 swings about the bracket supporting shaft 14 counterclockwise in FIG. 9D. Accordingly, the downstream tension roller 5 moves together with the bracket 12 to separate from the sheet stack 1.

By contrast, the upstream tension roller 6 remains in contact with the top of the sheet stack 1 along with the aid of gravity and moves relative to the bracket 12 toward the sheet stack 1. Consequently, the attraction belt 2 swings about the upstream tension roller 6 so that the uppermost sheet 1*a* attracted to the attraction belt 2 curves about the turning point the turning point of the attraction belt 2 on the upstream tension roller 6. As a result, the restoring force acts on the sheet attracted to the attraction belt 2. Accordingly, the uppermost sheet 1*a* is attracted to the attraction belt 2, and the second sheet 1*b* is separated from the attraction belt 2 by the restoring force of the sheet.

As the attraction/separation unit 110 further rotates about the bracket supporting shaft 14 counterclockwise in FIG. 9D, the shaft 6*a* of the upstream tension roller 6 abuts against the lower end surface 41*a* of the slot 12*a*. As the attraction/separation unit 110 further rotates from this state, the upstream tension roller 6 also moves together with movement of the bracket 12, resulting in separation of the upstream tension roller 6 from the top of the sheet stack 1.

Figure 9E:
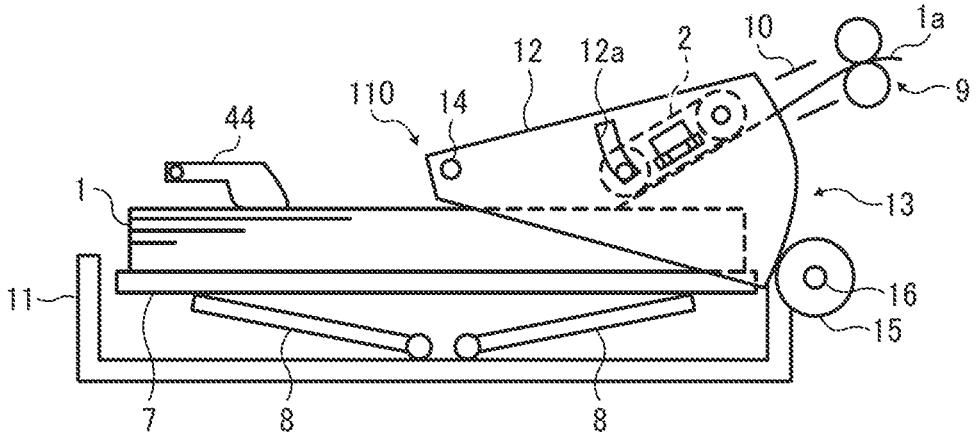

As illustrated in FIG. 9E, when the attraction/separation unit 110 reaches the sheet conveyance position to convey the sheet further, the swing motor 30 stops driving. Instead, the drive motor 24 is driven to rotate the attraction belt 2, thereby conveying the uppermost sheet 1*a* attracted to the attraction belt 2 to the pair of conveyance rollers 9. When the leading edge of the uppermost sheet 1*a* that is electrically attracted to the attraction belt 2 reaches the turning point of the attraction belt 2 on the downstream tension roller 5, the uppermost sheet 1*a* separates from the attraction belt 2 by self stripping due to the curvature and moves toward the pair of conveyance rollers 9 while being guided by the guide member 10 (see FIG. 9E).

The linear velocity of the pair of conveyance rollers 9 is controlled to be same as the linear velocity of the attraction belt 2. In a case in which the pair of conveyance rollers 9 is intermittently driven to adjust the timing, the drive motor 24 is controlled to drive the attraction belt 2 intermittently. Further, the driving mechanism 130 may include an electromagnetic clutch for controlling the drive of the attraction belt 2.

The paper attraction force due to the charge pattern acts on the uppermost sheet 1*a* but not on the second sheet 1*b* or the subsequent sheets. The present sheet feeding method does not use any friction force between the pickup unit and the sheet. Accordingly, the contact pressure between the attraction belt 2 and the sheet stack 1 can be reduced, thereby preventing multiple feeding of sheets due to friction.

The attraction belt 2 neither separates the second sheet 1*b* from the sheet stack 1 to prevent from nor attracts the second sheet 1*b* before the trailing edge of the uppermost sheet 1*a* reaches an opposed position to the upstream tension roller 6.

[Embodiment]1

Now, a description is given of the attraction/separation unit 110 according to Embodiment 1, with reference to FIGS. 10A through 10C and FIGS. 11-12.

Figure 10A:
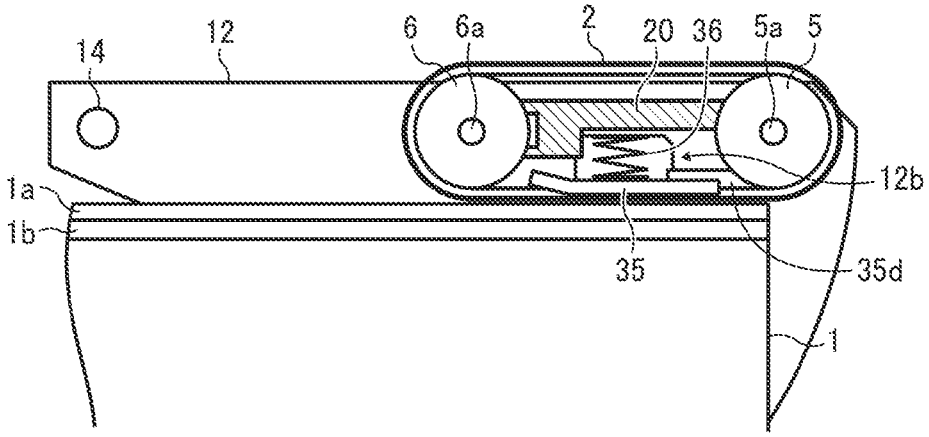
FIG. 10A is a diagram illustrating a state in which the attraction/separation unit is located at a sheet attraction position.
Figure 10B:
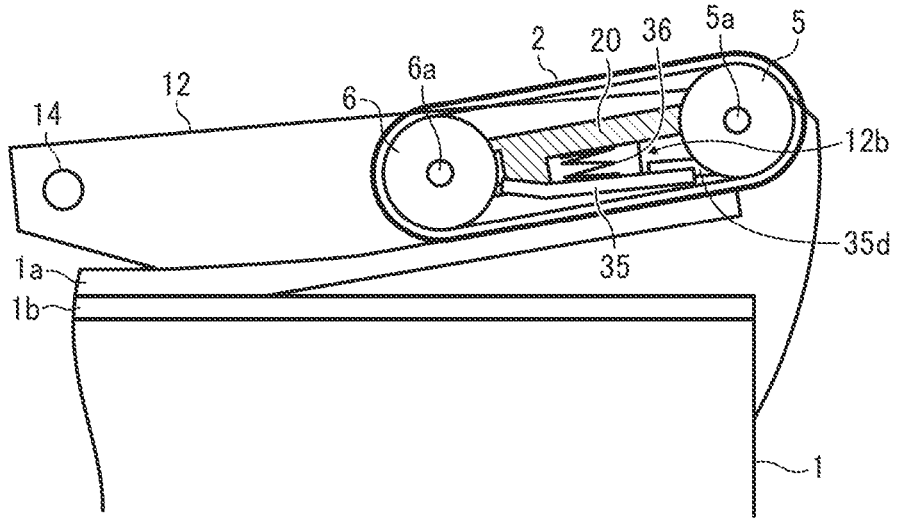
FIG. 10B is a diagram illustrating a state in which the attraction/separation unit is located at a sheet conveyance position.
Figure 10C:
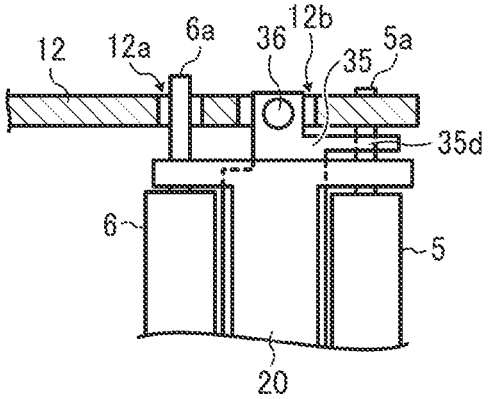
FIG. 10C is a top view illustrating one end of the attraction/separation unit in a lateral direction perpendicular to the sheet conveyance direction of the attraction/separation unit.

FIGS. 10A through 10C are diagrams of the attraction/separation unit 110. Specifically, FIG. 10A is a diagram illustrating a state in which the attraction/separation unit 110 is located at the sheet attraction position. FIG. 10B is a diagram illustrating a state in which the attraction/separation unit 110 is located at the sheet conveyance position. FIG. 10C is a top view illustrating one lateral end of the attraction/separation unit 110 in a lateral direction perpendicular to the sheet conveyance direction of the attraction/separation unit 110.

Figure 11:
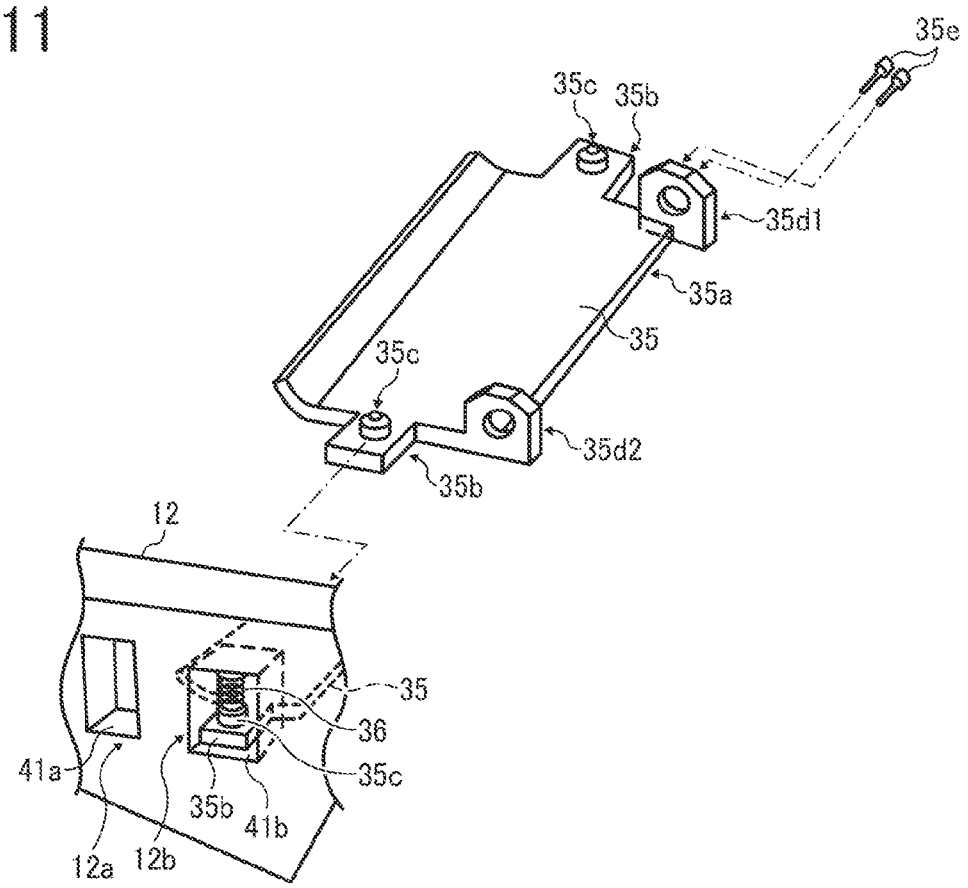
FIG. 11 is a perspective view illustrating a pressing unit to press the attraction belt.

Further, FIG. 11 is a perspective view illustrating a pressing unit 35 that is positioned inside the loop of the attraction belt 2 to press the attraction belt 2 against the sheet stack 1 when the attraction/separation unit 110 is located at the sheet attraction position.

As illustrated in FIG. 11, the pressing unit 35 includes a planar pressing member body 35*a*, two holders 35*b* provided at both lateral ends of the pressing member body 35*a*, compression spring bases 35*c*, two hole-bearing flanges 35*d*1 and 35*d*2, and a pair of fixing screws 35*e*.

The pressing member body 35*a* is contacted against the attraction belt 2 by compression springs 36 functioning as elastic members that are mounted on the compression spring bases 35*c* are projections. The hole-bearing flanges 35*d*1 and 35*d*2, through which the shaft 5*a* of the downstream tension roller 5 is inserted, are disposed at the downstream side in the sheet conveyance direction of the pressing member body 35*a*.

The hole-bearing flange 35*d*1 is detachably attached to the pressing member body 35*a* and is fixed to the pressing member body 35*a* with the pair of fixing screws 35*e*. When assembling the pressing unit 35 to the shaft 5*a* of the downstream tension roller 5, the detachable hole-bearing flange 35*d*1 is removed from the pressing member body 35*a* and the hole-bearing flange 35*d*2 is used to rotatably support the shaft 5*a* of the downstream tension roller 5. Then, while receiving the shaft 5*a* of the downstream tension roller 5, the detachable hole-bearing flange 35*d*1 is fixed to the pressing member body 35*a* using the pair of fixing screws 20*c*.

Figure 12:
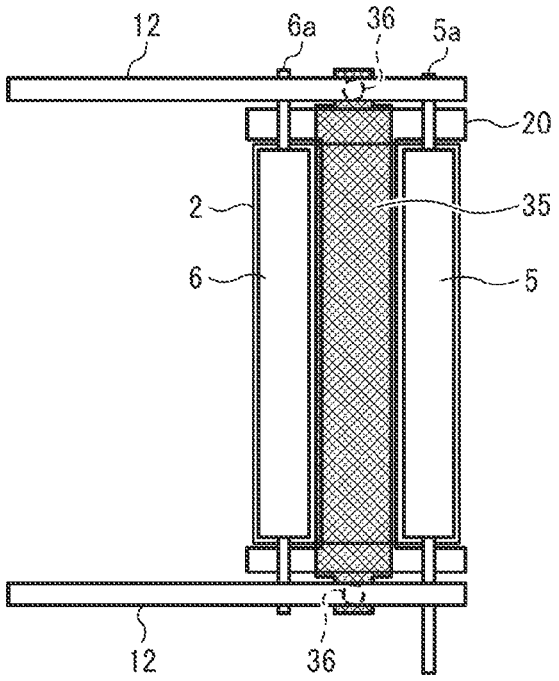
FIG. 12 is a top view illustrating the attraction/separation unit with a compression spring mounted on a bracket.

The compression spring 36 has one end that is engaged with the compression spring base 35*c* and another, opposite end connected to an upper end surface in the slot 12*b* of each bracket 12 of the attraction/separation unit 110. As illustrated in FIG. 12, the compression springs 36 press against the pressing unit 35 at both lateral ends of the attraction/separation unit 110, in other words, at the respective brackets 12.

Further, as illustrated in FIG. 10C, the pressing unit 35 is rotatably provided to the shaft 5*a* of the downstream tension roller 5 via the hole-bearing flanges 35*d*1 and 35*d*2. In sheet attraction, the pressing unit 35 presses the attraction belt 2 outward from inside the loop of the attraction belt 2 and the biasing force of the compression springs 36 biases the attraction belt 2 to abut against the top of the uppermost sheet 1*a*. This abutment of the attraction belt 2 to the uppermost sheet 1*a* prevents a gap from being formed between the attraction belt 2 and the uppermost sheet 1*a* due to their waviness or the like.

The pressing unit 35 can provide similar effectiveness with its width designed to be equal to or greater than the width of the sheet stack 1. However, the pressing unit 35 is most effective when covering the entire width of a sheet. Therefore, preferably the width of the pressing unit 35 is equal to or greater than the width of a sheet. Consequently, in the present embodiment, the width of the pressing unit 35 according to the present embodiment is greater than that of the largest sheet that the sheet conveyor 200 can accommodate. In addition, the uppermost sheet 1*a* is turned over or picked up from the edge thereof, so that air resistance can be prevented and the minimum amount of power may be used for turning or picking up the uppermost sheet 1*a* by avoiding folding or deforming the sheet.

Preferably, the length of the pressing unit 35 in the sheet conveyance direction is as large as possible. For example, it is preferable that the length be 70% to 80% of the length of the attraction belt 2 stretched flat between the downstream tension roller 5 and the upstream tension roller 6. With this configuration, a greater pressing area of the pressing unit 35 against the attraction belt 2 can be obtained than in the configuration in which the pressing unit 35 is a roller.

Next, a description is given of operations of the attraction/separation unit 110 from sheet attraction to sheet conveyance, with reference to FIGS. 13, 14A through 14C, and 15A through 15C.

Figure 14A:
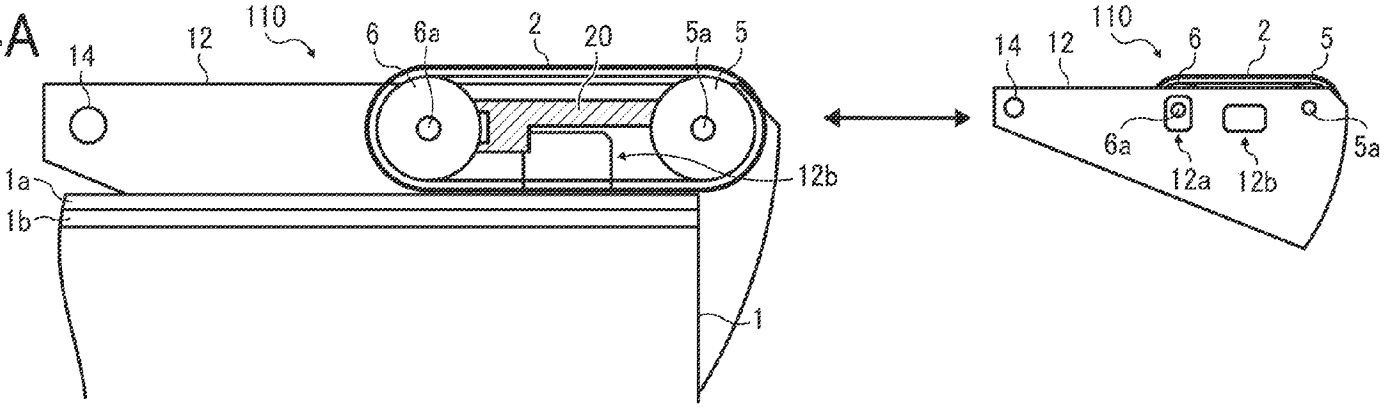
FIGS. 14A through 14C are diagrams illustrating the attraction/separation unit focusing on a housing (without illustrating the pressing unit and the compression spring)
Figure 14B:
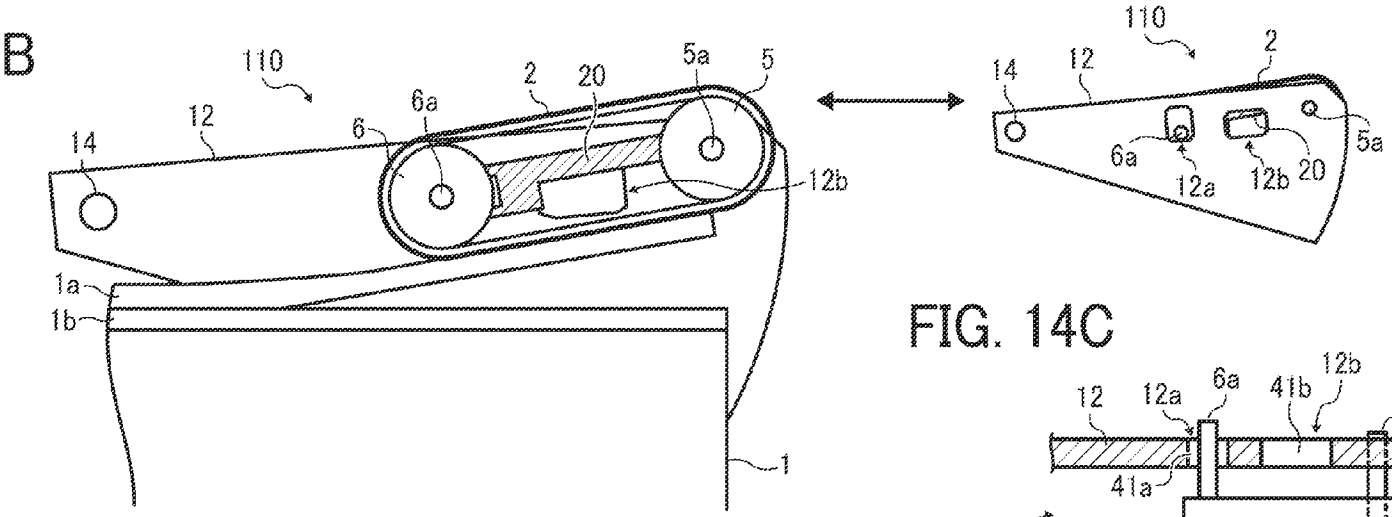
Figure 14C:
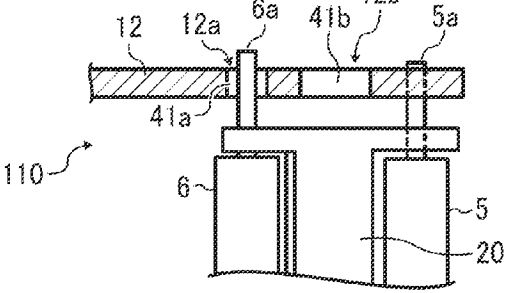

FIGS. 14A through 14C are diagrams focusing on the housing 20, and therefore the pressing unit 35 and the compression spring 35 of the attraction/separation unit 110 are omitted. Specifically, FIG. 14A is a diagram illustrating a state in which the attraction/separation unit 110 is located at the sheet attraction position. FIG. 14B is a diagram illustrating a state in which the attraction/separation unit 110 is located at the sheet conveyance position. FIG. 14C is a top view illustrating one lateral end of the attraction/separation unit 110.

Figures 15A, 15B, 15C:
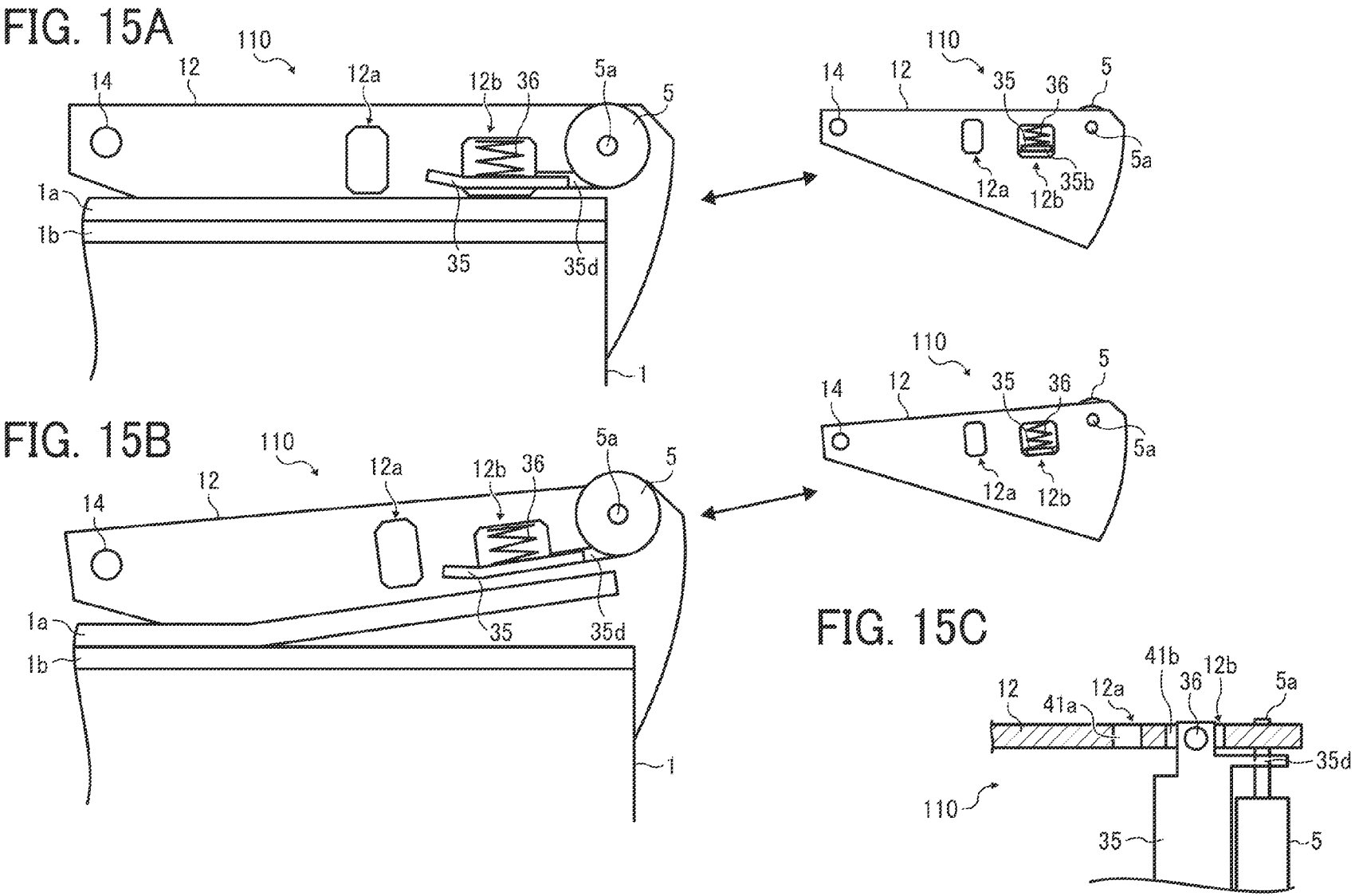
FIGS. 15A through 15C are diagrams illustrating the attraction/separation unit focusing on the pressing unit and the compression spring (without illustrating an upstream tension roller, the housing, and the attraction belt)

FIGS. 15A through 15C are diagrams focusing on the pressing unit 35 and the compression spring 36, and therefore for simplicity the upstream tension roller 6, the housing 20, and the attraction belt 2 are omitted. Specifically, FIG. 15 is a diagram illustrating a state in which the attraction/separation unit 110 is located at the sheet attraction position. FIG. 15B is a diagram illustrating a state in which the attraction/separation unit 110 is located at the sheet conveyance position. FIG. 15C is a top view illustrating the one lateral end of the attraction/separation unit 110.

Figure 13A:
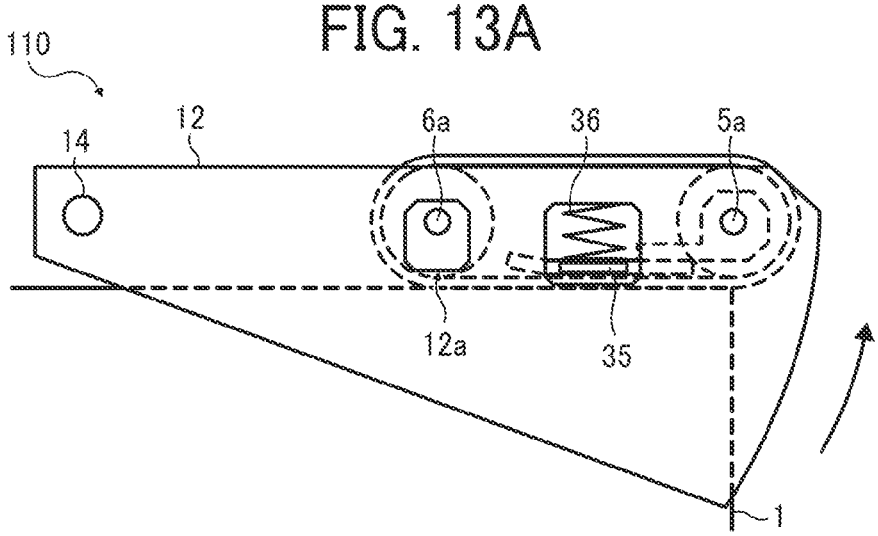
FIGS. 13A through 13C are diagrams illustrating operations of the attraction/separation unit from attraction of the sheet to conveyance of the sheet.

As illustrated in FIG. 13A, the attraction belt 2 is pressed by the pressing unit 35 to abut against the uppermost sheet 1*a* at the sheet attraction position. At this time, the shaft 6*a* of the upstream tension roller 6 and the holder 35*b* of the pressing unit 35 evacuate from respective lower end surfaces 41*a* and 41*b* of the slots 12*a* and 12*b*, respectively.

Figure 13B:
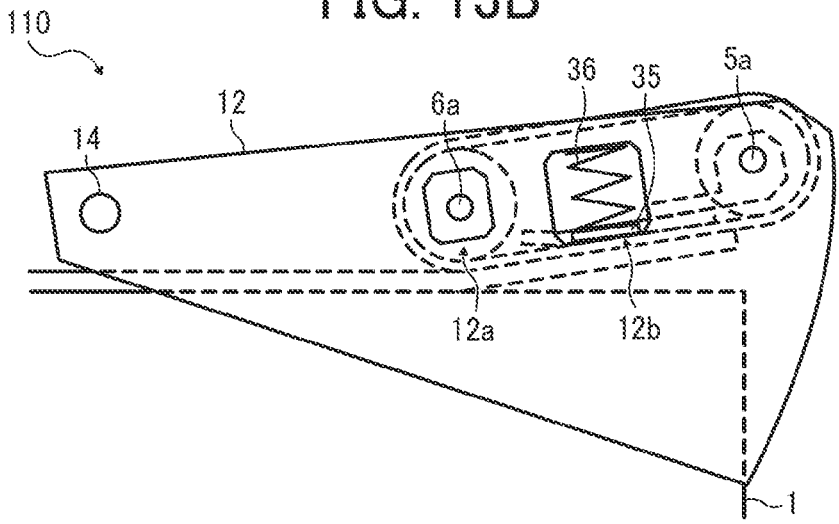

As the attraction/separation unit 110 is rotatably lifted from the sheet attraction position to the sheet conveyance position, the shaft 6*a* of the upstream tension roller 6 and the holder 35*b* of the pressing unit 35 move downward in the slots 12*a*. Then, as illustrated in FIG. 13B, the pressing unit 35 abuts against the lower end surface 41*b* of the slot 12*b* to be held there before the shaft 6*a* of the upstream tension roller 6 contacts the lower end surface 41*b* of the slot 12*b*.

Figure 13C:
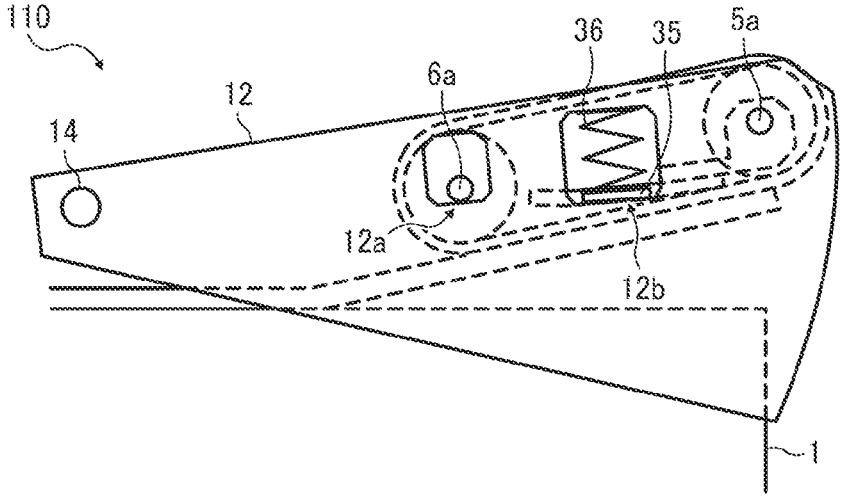

Further, when the attraction/separation unit 110 is swung toward the sheet conveyance position, the attraction/separation unit 110 is lifted and the pressing unit 35 elevates against the biasing force of the compression spring 36. Further, along with the movement of the pressing unit 35, the shaft 6*a* of the upstream tension roller 6 moves downward in the slot 12*a* and contacts the lower end surface 41*a* to be held there, as illustrated in FIG. 13C, thereby separating the pressing unit 35 from the inner circumferential surface of the attraction belt 2.

In the present embodiment, when the attraction/separation unit 110 moves from the sheet attraction position to the sheet conveyance position, the upstream tension roller 6 moves by less than the pressing unit 35 does. According to the difference between the range of movement of the upstream tension roller 6 and the range of movement of the pressing unit 35, a contact timing of the shaft 6*a* of the upstream tension roller 6 and the lower end surface 41*a* of the slot 12*a* is different from a contact timing of the holder 35*b* of the pressing unit 35 and the lower end surface 41*b* of the slot 12*b*. With this configuration, the pressing unit 35 can evacuate from the inner circumference of the attraction belt 2. Namely, the pressing unit 35 is elevated above the upstream tension roller 6 as the attraction/separation unit 110 moves from the sheet attraction position to the sheet conveyance position, and consequently, the pressing unit 35 separates from the inner circumferential surface of the attraction belt 2.

If the inner circumferential surface of the attraction belt 2 and the pressing unit 35 are in contact with each other when the attraction belt 2 rotates for sheet conveyance, the pressing force applied by the pressing unit 35 from the inner circumferential surface of the attraction belt 2 to the top surface of the sheet stack 1 may cause the pressing member 35 to slide along the inner circumference of the attraction belt 2. At this time, if the friction force exerted between the attraction belt 2 and the pressing unit 35 is greater than the friction force exerted between the attraction belt 2 and the downstream tension roller 5, the friction force between the attraction belt 2 and the pressing unit 35 applies a load to the attraction belt 2 during rotation. The load to the attraction belt 2 may cause the attraction belt 2 to slip on the downstream tension roller 5, resulting in rotation failure of the attraction belt 2.

If the pressing unit 35 includes a material having a relatively small sliding friction, if a contact area of the pressing unit 35 to the attraction belt 2 is reduced, or if the pressure of the pressing unit 35 to the attraction belt 2 is reduced, the configuration may be negatively affected by these limitations. The limitations can make it difficult to maintain the appropriate contact between the attraction belt 2 and the uppermost sheet 1*a* by pressing the attraction belt 2 by the pressing unit 35.

By contrast, the present embodiment can switch between a state in which the pressing unit 35 contacts the attraction belt 2 and a state in which the pressing unit 35 separates from the attraction belt 2. Namely, the pressing unit 35 contacts and presses the attraction belt 2 when the attraction/separation unit 110 is at the sheet attraction position and the pressing unit 35 separates from the attraction belt 2 when the attraction/separation unit 110 stays at the sheet conveyance position.

As a result, the attraction belt 2 can be rotated while the pressing unit 35 is separated from the attraction belt 2 for conveying the uppermost sheet 1*a* from the sheet conveyance position. Therefore, the attraction/separation unit 110 is not negatively affected by the friction force exerted between the attraction belt 2 and the pressing unit 35 and the attraction belt 2 does not receive the load for rotation. Consequently, slippage of the attraction belt 2 on the downstream tension roller 5 can be prevented, so that the rotation failure of the attraction belt 2 can be avoided. With this configuration, the area and pressure for the pressing unit 35 to obtain the contact between the attraction belt 2 and the uppermost sheet 1*a* can be set without having the above-described limitations. Accordingly, while preventing the rotation failure of the attraction belt 2, the contact between the attraction belt 2 and the uppermost sheet 1*a* can be maintained.

When the attraction/separation unit 110 swings from the sheet attraction position to the sheet conveyance position to pick up and separate the uppermost sheet 1*a* from the sheet stack 1, the pressing unit 35 may slide along the inner circumferential surface of the attraction belt 2 until the pressing unit 35 separates therefrom. Due to the sliding of the pressing unit 35, torque may be exerted to rotate the attraction belt 2. At this time, if the coefficient of friction of the pressing unit 35 to the inner circumferential surface of the attraction belt 2 is lower than the coefficient of friction of the outer circumferential surface of the downstream tension roller 5 to the inner circumference of the attraction belt 2, the torque thus generated may cause the downstream tension roller 5 to slip on the attraction belt 2, which is likely to slightly rotate the attraction belt 2. Thus, rotation of the attraction belt 2 may disposition the leading edge of the uppermost sheet 1*a* attracted to the attraction belt 2 from its appropriate position, resulting in a cause of a conveyance failure.

To avoid the possibility of the above-described failure, the present embodiment sets the coefficient of friction of the contact surface of the pressing unit 35 with the inner circumferential surface of the attraction belt 2 greater than the coefficient of friction of the outer circumferential surface of the downstream tension roller 5 with the inner circumferential surface of the attraction belt 2. With this setting, even if torque is generated, the downstream tension roller 5 may not slip on the attraction belt 2, so that the rotation of the attraction belt 2 can be prevented. Therefore, disposition of the leading edge of the uppermost sheet 1*a* attracted to the attraction belt 2 can be prevented, thereby avoiding the conveyance failure.

[Embodiment 2]

Next, a description is given of operations of an attraction/separation unit 110A according to Embodiment 2, with reference to FIGS. 16A through 16C, 17A, and 17B.

Figure 16A:
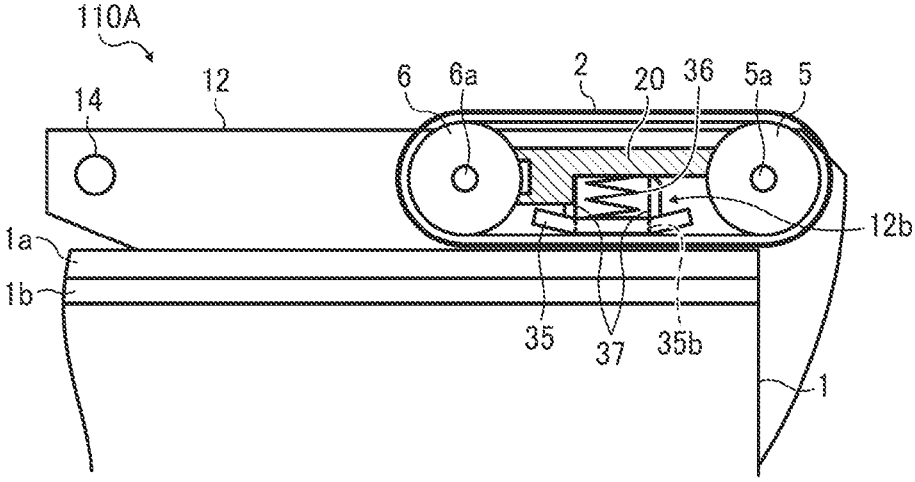
FIG. 16A is a diagram illustrating a state in which an attraction/separation unit according to another embodiment is located at the sheet attraction position.
Figure 16B:
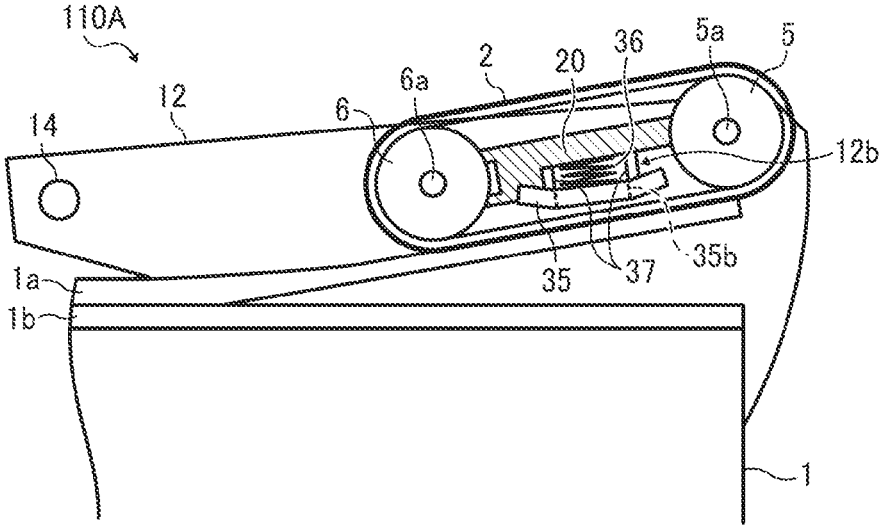
FIG. 16B is a diagram illustrating a state in which the attraction/separation unit is located at the sheet conveyance position.
Figure 16C:
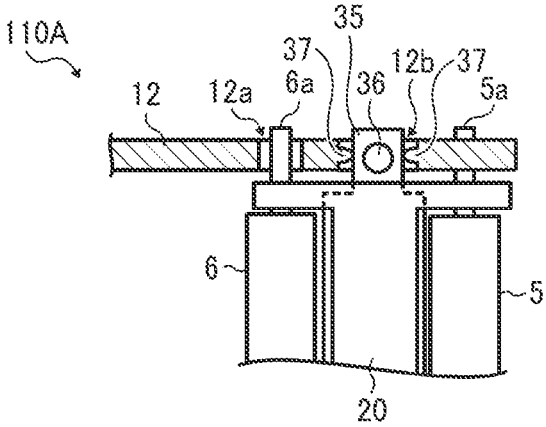
FIG. 16C is a top view illustrating one end of the attraction/separation unit in a lateral direction perpendicular to the sheet conveyance direction of the attraction/separation unit.
Figure 17A:
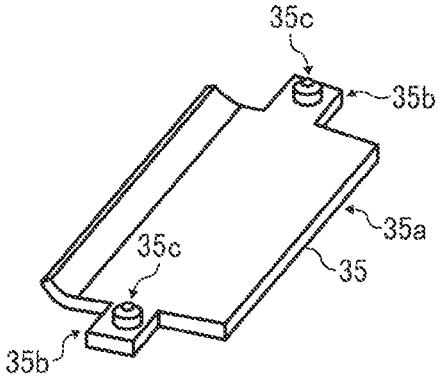
FIG. 17A is a perspective view of the pressing unit according to another embodiment.
Figure 17B:
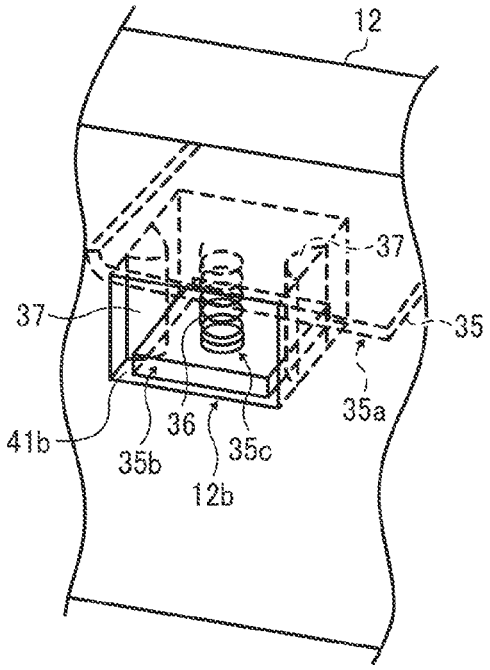
FIG. 17B is an enlarged view around a slot of the bracket having the pressing unit.

FIGS. 16A through 16C are diagrams of the attraction/separation unit 110A. Specifically, FIG. 16A is a diagram illustrating a state in which the attraction/separation unit 110A is located at the sheet attraction position. FIG. 16B is a diagram illustrating a state in which the attraction/separation unit 110A is located at the sheet conveyance position. FIG. 16C is a top view illustrating one lateral end of the attraction/separation unit 110A. Further, FIG. 17A is a perspective view of the pressing unit 35 according to Embodiment 2 and FIG. 17B is an enlarged view around the slot 12*b* of the bracket 12 having the pressing unit 35.

In Embodiment 2, the basic configuration of the sheet conveyor 200 and how the pressing unit 35 separates from the attraction belt 2 are the same as those of Embodiment 1. However, how the pressing unit 35 in Embodiment 2 is held is different from Embodiment 1. Namely, as illustrated in FIGS. 16A, 16B, 16C, 17A, and 17B, the holder 35*b* is held by the slot 12*b* so that both end surfaces of the holder 35*b* of the pressing unit 35 in the sheet conveyance direction can slide together with projecting sliding portions 37 mounted on both end surfaces in the slot 12*b* of the bracket 12. How the pressing unit 35 is held to the attraction/separation unit 110A can be determined by the angle and arrangement of the upstream tension roller 6 relative to the attraction/separation unit 110A.

[Embodiment]3

Figure 18:
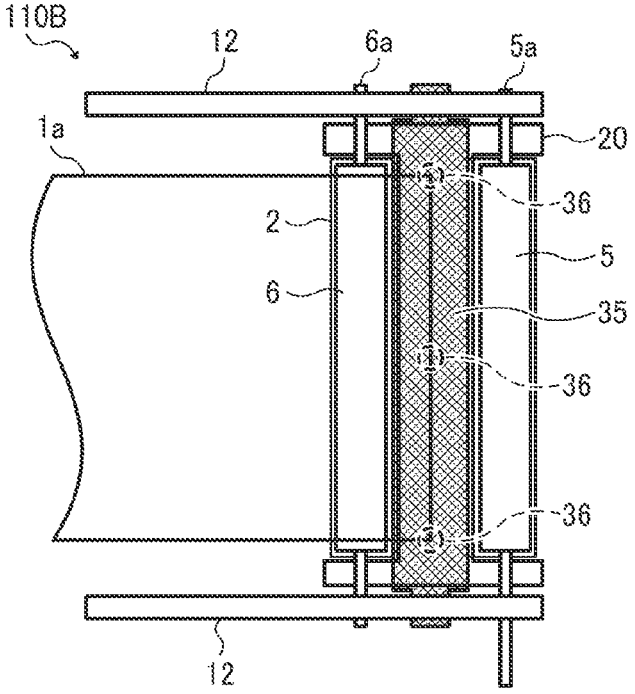
FIG. 18 is a top view illustrating yet another attraction/separation unit having the compression spring disposed between the brackets in the lateral direction and within the width of the attraction belt.

Next, a description is given of operations of an attraction/separation unit 110B according to Embodiment 3, with reference to FIG. 18.

As illustrated in FIG. 18, the compression springs 36 are disposed in the housing 20, between the brackets 12 in the lateral direction and within the width of the attraction belt 2 to press the pressing unit 35.

It is most suitable for assembly and replacement that the compression springs 36 are disposed on the respective brackets 12 of the attraction/separation unit 110 as described in Embodiments 1 and 2. However, for attraction of a sheet having the width of 297 mm such as A4-landscape size and A3-portrait size, it is preferable to dispose the compression springs 36 to press the sheet at or about both lateral ends thereof. Specifically, the compression springs 36 provided in the housing 20 located at the inner circumferential surface of the attraction belt 2 can obtain a greater effect in adhesion than the compression springs 36 provided on the respective brackets 12 disposed at the respective lateral ends of the attraction/separation unit 110.

With this configuration, variation in a total weight of the housing 20 and units and components held by the housing 20 (hereinafter, referred to as a total weight of the housing) and a total amount of force of the compression spring 36 may cause the following differences.

Namely, if the total weight of the housing is greater than the total amount of force of the compression spring 36, the force of the compression spring 36 is released from the downstream tension roller 5 and the upstream tension roller 6. However, the downstream tension roller 5, the upstream tension roller 6, and the pressing unit 35 contact the top of the uppermost sheet 1*a* via the attraction belt 2.

By contrast, if the total amount of force of the compression spring 36 is greater than the total weight of the housing, the lower portions of the downstream tension roller 5 and the upstream tension roller 6 are released, and the lower portion of the pressing unit 35 is pressed hard.

The force of the compression spring 36 with respect to the total weight of the housing can be determined based on the positional relation of the attraction belt 2 and the uppermost sheet 1*a* and a position of the attraction belt 2 to contact the uppermost sheet 1*a*. In the present embodiment, it is preferable that the total amount of force of the compression spring 36 is designed to be greater than the total weight of the housing.

Since the attraction belt 2 and the uppermost sheet 1*a* most surely contact just under the compression spring 36, the uppermost sheet 1*a* can be attracted to the attraction belt 2 reliably. After the uppermost sheet 1*a* has been attracted to the attraction belt 2, the attraction/separation unit 110 swings to lift and separate the uppermost sheet 1*a* from the sheet stack 1 by picking up the edge of the uppermost sheet 1*a*. To prevent failure of picking up the uppermost sheet 1*a* due to an insufficient attraction force of the attraction belt 2 or attraction of multiple sheets from the sheet stack 1, it is desired to attract the downstream edge of the uppermost sheet 1*a* reliably.

For this reason, the present embodiment includes the compression spring 36 that is disposed at downstream ends of the uppermost sheet 1*a* in the sheet conveyance direction. Consequently, the contact of the attraction belt 2 and the uppermost sheet 1*a* becomes strongest just under the compression spring 36, which is most suitable for obtaining the contact of the attraction belt 2 and the uppermost sheet 1*a* at downstream ends of the uppermost sheet 1*a* in the sheet conveyance direction.

Further, if the width of the attraction belt 2 or a length of the attraction belt 2 in the lateral direction perpendicular to the sheet conveyance direction is nearly equal to the width of the sheet stack 1, the width of the attraction belt 2 is about 300 mm in the sheet conveyance direction. In consequence, the pressing unit 35 also becomes long in the lateral direction. Therefore, even if the compression spring 36 presses the pressing unit 35 at the lateral ends thereof, the pressing unit 35 may deform in the lateral direction and therefore the pressure is reduced at the center of the pressing unit 35 in the lateral direction. To avoid this problem, the housing 20 disposed inside the loop of the attraction belt 2 may function as a pedestal of the compression spring 36, and a pressure load is applied to the pressing unit 35 by the compression spring 36, so that the pressing unit 35 can apply the load to the center part or optional part of the attraction belt 2.

Further, as described in Embodiment 1, if the compression springs 36 are attached to the brackets 12 of the attraction/separation unit 110, the attraction/separation unit 110 may need to be moved to the sheet attraction position against the pressing force of the compression spring 36 to the pressing unit 35. If the pressing force is too strong, the torque to rotate the attraction/separation unit 110 increases. Therefore, by disposing the compression springs 36 to the housing 20 rotatably supported by the shaft 5*a* of the downstream tension roller 5, an increase in torque can be prevented and the load of the housing and the downstream tension roller 5 can be distributed to the surface of the pressing unit 35 to utilize for obtaining the adhesion of the sheet to the attraction belt 2.

[Embodiment]4

Figure 19A:
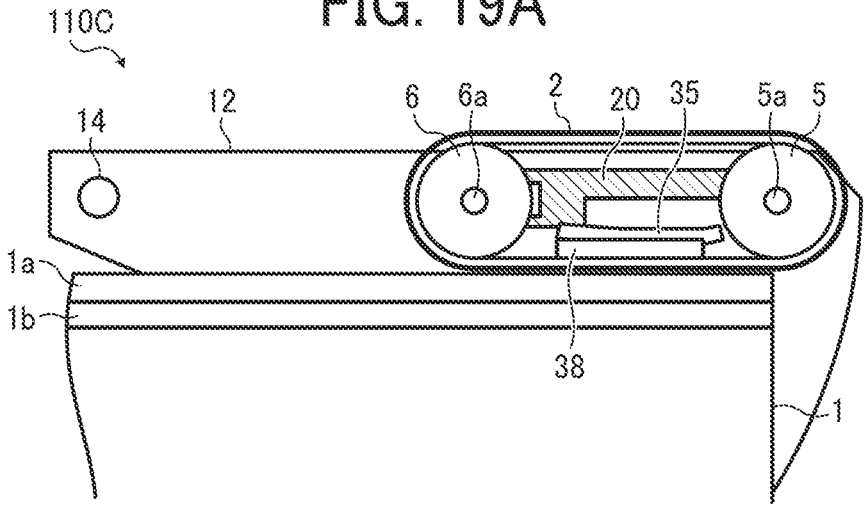
FIG. 19A is a diagram illustrating a state in which an attraction/separation unit according to yet another embodiment is located at the sheet attraction position.
Figure 19B:
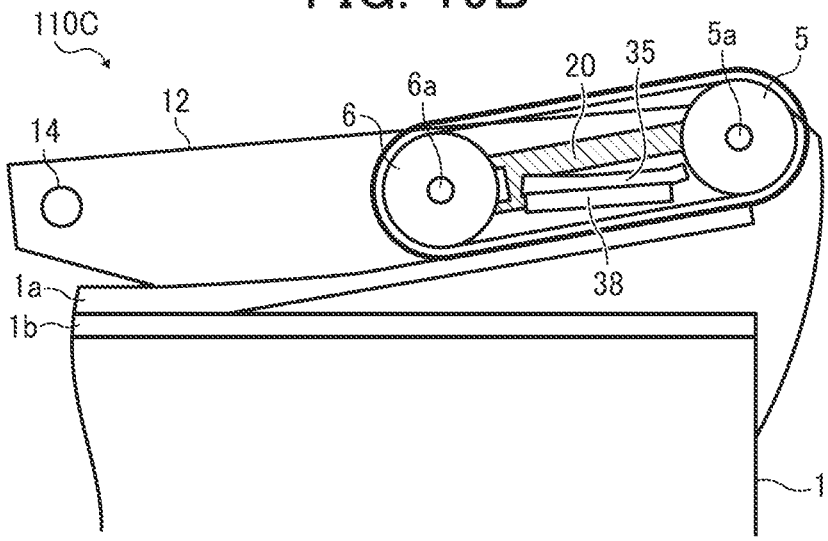
FIG. 19B is a diagram illustrating a state in which the attraction/separation unit is located at the sheet conveyance position.
Figure 19C:
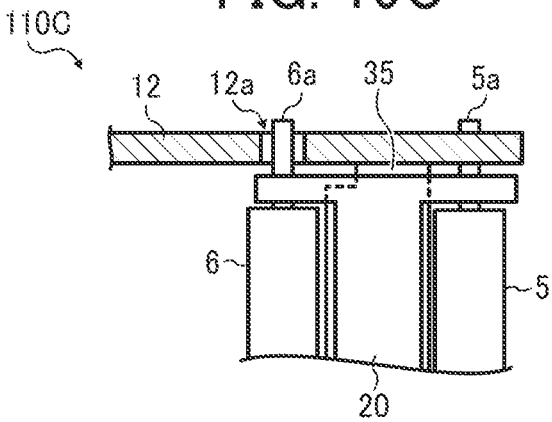
FIG. 19C is a top view illustrating one end of the attraction/separation unit in a lateral direction perpendicular to the sheet conveyance direction of the attraction/separation unit.

Next, a description is given of operations of an attraction/separation unit 110C according to Embodiment 4, with reference to FIGS. 19A through 19C.

FIGS. 19A through 19C are diagrams of the attraction/separation unit 110C. Specifically, FIG. 19A is a diagram illustrating a state in which the attraction/separation unit 110C is located at the sheet attraction position. FIG. 19B is a diagram illustrating a state in which the attraction/separation unit 110C is located at the sheet conveyance position. FIG. 19C is a top view illustrating one lateral end of the attraction/separation unit 110C.

In the present embodiment, the bracket 12 and the pressing unit 35 are formed as a single integrated unit. With this configuration, the pressing unit 35 is fixed to the bracket 12. Therefore, when the attraction/separation unit 110C descends, it may be difficult to adjust the position of the pressing unit 35 and the sheet stack 1. It is to be noted that the bracket 12 and the pressing unit 35 may be provided separately to fix the pressing unit 35 to the bracket 12. However, even with such a configuration, the adjustment of the relative position of the pressing unit 35 and the sheet stack 1 is difficult.

Therefore, in the present embodiment, a flexible member 38 such as moltoprene sponge is provided at a bottom of the pressing member 35 such that the flexible member 38 faces the sheet stack 1. When the pressing unit 35 presses the attraction belt 2, the flexible member 38 deforms, so that the relative position between the pressing unit 35 and the sheet stack 1 can be appropriately adjusted via the attraction belt 2. The flexible member provided below the pressing unit 35 is not limited to the flexible member 38. For example, a spring and a mold can be integrated as a single flexible member to be provided below the pressing unit 35.

By fixing the pressing unit 35 to the bracket 12 as in the attraction/separation unit 110C, when the upstream tension roller 6 is moved lower than the attraction/separation unit 110C while swinging the attraction/separation unit 110 from the sheet attraction position to the sheet conveyance position, the pressing unit 35 can separate from the attraction belt 2 reliably even with a small angle of movement of the upstream tension roller 6. In addition, since there is no need to open the slot 12*b* to hold the pressing unit 35 to the bracket 12 and to provide the compression spring 36 to press the pressing unit 35 toward the attraction belt 2, a simpler configuration can be achieved.

The above-described embodiments are illustrative and do not limit the present invention. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

What is claimed is:

1. A sheet conveyor comprising:

an attraction/separation unit, comprising, an endless attraction belt disposed facing a top surface of a sheet stack, a first tension roller, and a second tension roller located upstream from the first tension roller in a sheet conveyance direction to stretch the attraction belt taut together with the first tension roller, the attraction belt being wound about the rollers in a loop, rotatably supported by the first tension roller and the second tension roller;

a support member to support the attraction/separation unit;

a roller drive unit to be operatively connected to one of the first tension roller and the second tension roller;

a charging member to uniformly charge a surface of the attraction belt;

a mechanism to swing the attraction/separation unit to move the attraction belt reciprocally about the support member between a sheet attraction position at which the uppermost sheet of the sheet stack contacts and attracts the attraction belt and a sheet conveyance position at which the uppermost sheet attracted to the attraction belt is conveyed, the sheet conveyance position being located farther from the sheet stack than the sheet attraction position;

a pressing member disposed inside the loop into which the attraction belt is formed to press the attraction belt against the sheet stack at the sheet attraction position, the pressing member separating from the attraction belt at the sheet conveyance position; and a flexible member provided at a bottom of the pressing member to face the sheet stack, wherein the pressing member is fixed to the attraction/separation unit.

2. The sheet conveyor according to claim 1, wherein the second tension roller and the pressing member are supported to vertically move within a desired range with respect to the top surface of the sheet stack, wherein a range of movement of the second tension roller is smaller than a range of movement of the pressing roller as the attraction/separation unit swings from the sheet attraction position to the sheet conveyance position.

3. The sheet conveyor according to claim 1, wherein a coefficient of friction of an outer circumferential surface of the first tension roller to an inner circumferential surface of the attraction belt is greater than a coefficient of friction of a contact surface of the pressing member to the inner circumferential surface of the attraction belt.

4. An image forming apparatus comprising:

an image forming device to form an image on a surface of a sheet; and the sheet conveyor according to claim 1.

5. A sheet conveyor comprising:

an attraction/separation unit, comprising, an endless attraction belt disposed facing a top surface of a sheet stack, a first tension roller, and a second tension roller located upstream from the first tension roller in a sheet conveyance direction to stretch the attraction belt taut together with the first tension roller, the attraction belt being wound about the rollers in a loop, rotatably supported by the first tension roller and the second tension roller;

a support member to support the attraction/separation unit;

a roller drive unit to be operatively connected to one of the first tension roller and the second tension roller;

a charging member to uniformly charge a surface of the attraction belt;

a mechanism to swing the attraction/separation unit to move the attraction belt reciprocally about the support member between a sheet attraction position at which the uppermost sheet of the sheet stack contacts and attracts the attraction belt and a sheet conveyance position at which the uppermost sheet attracted to the attraction belt is conveyed, the sheet conveyance position being located farther from the sheet stack than the sheet attraction position;

a pressing member disposed inside the loop into which the attraction belt is formed to press the attraction belt against the sheet stack at the sheet attraction position, the pressing member separating from the attraction belt at the sheet conveyance position;

a housing rotatably disposed to a rotation shaft of the first tension roller; and an elastic member to elastically bias the pressing member, the elastic member having one end contacting the pressing member and an other end contacting the housing.

6. The sheet conveyor according to claim 5, wherein the second tension roller and the pressing member are supported to vertically move within a desired range with respect to the top surface of the sheet stack, wherein a range of movement of the second tension roller is smaller than a range of movement of the pressing roller as the attraction/separation unit swings from the sheet attraction position to the sheet conveyance position.

7. The sheet conveyor according to claim 5, wherein a coefficient of friction of an outer circumferential surface of the first tension roller to an inner circumferential surface of the attraction belt is greater than a coefficient of friction of a contact surface of the pressing member to the inner circumferential surface of the attraction belt.

8. An image forming apparatus comprising:

an image forming device to form an image on a surface of a sheet; and the sheet conveyor according to claim 5.

9. A sheet conveyor comprising:

an attraction/separation unit, comprising, an endless attraction belt disposed facing a top surface of a sheet stack, a first tension roller, and a second tension roller located upstream from the first tension roller in a sheet conveyance direction to stretch the attraction belt taut together with the first tension roller, the attraction belt being wound about the rollers in a loop, rotatably supported by the first tension roller and the second tension roller;

a support member to support the attraction/separation unit;

a roller drive unit to be operatively connected to one of the first tension roller and the second tension roller;

a charging member to uniformly charge a surface of the attraction belt;

a mechanism to swing the attraction/separation unit to move the attraction belt reciprocally about the support member between a sheet attraction position at which the uppermost sheet of the sheet stack contacts and attracts the attraction belt and a sheet conveyance position at which the uppermost sheet attracted to the attraction belt is conveyed, the sheet conveyance position being located farther from the sheet stack than the sheet attraction position;

a pressing member disposed inside the loop into which the attraction belt is formed to press the attraction belt against the sheet stack at the sheet attraction position, the pressing member separating from the attraction belt at the sheet conveyance position, wherein a width of the pressing member in a direction perpendicular to the sheet conveyance direction is greater than a width of the largest sheet that the sheet conveyor is designed to accommodate.

10. The sheet conveyor according to claim 9, further comprising an elastic member to elastically bias the pressing member with respect to a downstream end of the sheet stack in the sheet conveyance direction.

11. The sheet conveyor according to claim 9, wherein the second tension roller and the pressing member are supported to vertically move within a desired range with respect to the top surface of the sheet stack, wherein a range of movement of the second tension roller is smaller than a range of movement of the pressing roller as the attraction/separation unit swings from the sheet attraction position to the sheet conveyance position.

12. The sheet conveyor according to claim 9, wherein a coefficient of friction of an outer circumferential surface of the first tension roller to an inner circumferential surface of the attraction belt is greater than a coefficient of friction of a contact surface of the pressing member to the inner circumferential surface of the attraction belt.

13. An image forming apparatus comprising:

an image forming device to form an image on a surface of a sheet; and the sheet conveyor according to claim 9.

* * * * *